US012509882B2

(12) United States Patent
Johnson et al.

(10) Patent No.: US 12,509,882 B2
(45) Date of Patent: Dec. 30, 2025

(54) TIMBER-CONCRETE COMPOSITE CONNECTOR AND DUCTILE REINFORCEMENT CHAIR

(71) Applicant: SOM IW HOLDINGS, LLC, New York, NY (US)

(72) Inventors: Benton Johnson, Chicago, IL (US); Mark Peter Sarkisian, San Francisco, CA (US)

(73) Assignee: SOM IW HOLDINGS, LLC, New York, NY (US)

( * ) Notice: Subject to any disclaimer, the term of this patent is extended or adjusted under 35 U.S.C. 154(b) by 207 days.

(21) Appl. No.: 18/159,937

(22) Filed: Jan. 26, 2023

(65) Prior Publication Data

US 2024/0254771 A1 Aug. 1, 2024

(51) Int. Cl.

| | |
|---|---|
| ***E04C 5/18*** | (2006.01) |
| *E04B 5/02* | (2006.01) |
| *E04B 5/12* | (2006.01) |
| *E04B 5/23* | (2006.01) |
| *E04B 5/32* | (2006.01) |
| *E04B 5/38* | (2006.01) |
| *E04C 2/26* | (2006.01) |

(52) U.S. Cl.
CPC *E04C 5/18* (2013.01); *E04B 5/12* (2013.01); *E04B 5/23* (2013.01); *E04B 2005/237* (2013.01); *E04B 5/32* (2013.01); *E04B 5/38* (2013.01); *E04C 2/26* (2013.01); *E04C 2/50* (2013.01)

(58) Field of Classification Search
CPC ..... E04C 5/18; E04B 5/12; E04B 5/32
USPC ..... 52/414, 684, 677
See application file for complete search history.

(56) References Cited

U.S. PATENT DOCUMENTS

| | | | | | |
|---|---|---|---|---|---|
| 824,595 | A * | 6/1906 | Scofield | E04C 5/18 | 52/687 |
| 946,987 | A * | 1/1910 | Schade | E04C 5/18 | 403/374.2 |
| 1,052,788 | A * | 2/1913 | Bates | E04B 1/161 | 52/378 |
| 1,254,853 | A * | 1/1918 | Schoenthaler | E04C 5/18 | 52/684 |

(Continued)

FOREIGN PATENT DOCUMENTS

| | | | | |
|---|---|---|---|---|
| BR | PI0701851 A2 * | 11/2008 | E04G 11/40 |
| CN | 106760109 A * | 5/2017 | E04B 5/32 |

(Continued)

OTHER PUBLICATIONS

PCT Written Opinion and Search Report issued in related PCT Application No. PCT/US2024/010297 mailed Apr. 11, 2024.

(Continued)

*Primary Examiner* — Brian D Mattei
*Assistant Examiner* — Joseph J. Sadlon
(74) *Attorney, Agent, or Firm* — David R. Metzger; DENTONS US LLP

(57) ABSTRACT

A timber-concrete composite floor or roof system connector that provides high slip modulus stiffness and resiliency through a combination of mechanical and adhesive connections to a timber substrate, ductile structural behavior under ultimate loading, and an integrated method for chair support of concrete slab reinforcing members during wet concrete placement.

25 Claims, 18 Drawing Sheets

(56) References Cited

U.S. PATENT DOCUMENTS

| | | | | | |
|---|---|---|---|---|---|
| 1,378,202 | A * | 5/1921 | Voelpel | E04C 5/18 | 52/260 |
| 1,421,807 | A * | 7/1922 | Metzger | E04C 5/18 | 52/684 |
| 1,492,441 | A * | 4/1924 | Foster | E04C 5/18 | 52/649.4 |
| 2,260,973 | A * | 10/1941 | Healey | E04C 5/18 | 52/684 |
| 2,439,428 | A * | 4/1948 | Hillberg | E01C 11/14 | 404/136 |
| 3,283,466 | A * | 11/1966 | Grebner | E04C 5/065 | 52/340 |
| 3,334,458 | A * | 8/1967 | Leemhuis | E04B 5/326 | 52/223.6 |
| 3,529,392 | A * | 9/1970 | Adams | E04C 5/20 | 52/687 |
| 3,642,559 | A * | 2/1972 | Stokes | E04C 3/29 | 428/56 |
| 3,968,286 | A * | 7/1976 | Megumi | B32B 21/04 | 442/13 |
| 4,120,065 | A * | 10/1978 | Sivachenko | E01D 19/103 | 14/24 |
| 4,441,292 | A * | 4/1984 | Ericsson | E04B 5/10 | 52/309.7 |
| 4,602,467 | A * | 7/1986 | Schilger | E04C 2/284 | 52/319 |
| 4,689,867 | A * | 9/1987 | Tolliver | E04C 5/18 | 249/91 |
| 4,942,714 | A * | 7/1990 | Langley, Jr. | E01C 11/18 | 52/687 |
| 5,987,680 | A * | 11/1999 | Sakaya | E01D 19/125 | 404/70 |
| 6,625,948 | B2 * | 9/2003 | Valente | E04B 5/36 | 52/745.1 |
| 6,722,097 | B2 * | 4/2004 | Haslem | E04C 5/20 | 52/687 |
| 6,742,315 | B2 * | 6/2004 | Linn | E04C 2/26 | 52/745.1 |
| 8,015,771 | B2 * | 9/2011 | LeBlang | E04B 5/265 | 52/336 |
| 8,453,413 | B2 * | 6/2013 | Matiere | E04B 5/40 | 405/184.2 |
| 8,485,873 | B2 * | 7/2013 | Sisk | E21F 1/14 | 454/169 |
| 8,495,846 | B2 * | 7/2013 | Bravinski | E04B 5/48 | 52/340 |
| 8,707,644 | B2 * | 4/2014 | Degen | E04B 1/6116 | 52/414 |
| 9,169,643 | B2 * | 10/2015 | Dryburgh | B28B 7/0014 | |
| 9,222,260 | B1 * | 12/2015 | Hao | E04C 2/3405 | |
| 9,260,867 | B2 * | 2/2016 | Arnold | E01C 11/08 | |
| 9,518,401 | B2 * | 12/2016 | Wang | E04B 5/29 | |
| 10,323,368 | B2 * | 6/2019 | Mullaney | E02D 27/013 | |
| 10,329,768 | B2 * | 6/2019 | Verelli | E04C 5/168 | |
| 10,597,863 | B2 * | 3/2020 | Slaven, Jr. | E04B 1/043 | |
| 10,731,332 | B1 * | 8/2020 | Iverson | E04B 1/486 | |
| 11,060,273 | B2 | 7/2021 | Slaven, Jr. et al. | | |
| 12,024,883 | B2 * | 7/2024 | Eronen | E04B 5/266 | |
| 12,146,313 | B2 * | 11/2024 | Holland | E04B 1/58 | |
| 2004/0074183 | A1 | 4/2004 | Schneider et al. | | |
| 2007/0157542 | A1 | 7/2007 | Peterson | | |
| 2007/0261329 | A1 * | 11/2007 | Rigsby | E04C 2/06 | 52/223.6 |
| 2007/0278379 | A1 | 12/2007 | Marker | | |
| 2010/0065716 | A1 | 3/2010 | Amend | | |
| 2010/0319295 | A1 | 12/2010 | Nelson | | |
| 2012/0233956 | A1 * | 9/2012 | Fey | E04C 5/167 | 52/677 |
| 2017/0254085 | A1 * | 9/2017 | Larkin | E04C 5/18 | |
| 2020/0002932 | A1 * | 1/2020 | Hardy | E04B 1/0038 | |
| 2022/0213684 | A1 | 7/2022 | Besjak et al. | | |
| 2022/0259854 | A1 | 8/2022 | Ebisawa | | |

FOREIGN PATENT DOCUMENTS

| | | | | | |
|---|---|---|---|---|---|
| CN | 109112953 | A | 1/2019 | | |
| CN | 208594630 | U | 3/2019 | | |
| CN | 208844746 | U | 5/2019 | | |
| CN | 209942003 | U | 1/2020 | | |
| DE | 19828607 | A1 | 12/1999 | | |
| DE | 102019106018 | A1 * | 10/2019 | | E04B 5/23 |
| EP | 0176815 | A2 * | 4/1986 | | E04C 5/18 |
| EP | 0541880 | A1 * | 5/1993 | | E04C 5/18 |
| EP | 0939175 | A2 | 9/1999 | | |
| EP | 0717149 | B1 | 8/2000 | | |
| ES | 2318979 | | 5/2009 | | |
| ES | 2629607 | A1 | 8/2017 | | |
| FR | 726897 | A | 6/1932 | | |
| FR | 910506 | A | 6/1946 | | |
| FR | 1346947 | A * | 12/1963 | | E04C 5/18 |
| FR | 2652600 | A2 | 4/1991 | | |
| JP | 2017072022 | A | 4/2017 | | |
| KR | 20100078640 | A * | 7/2010 | | E04B 5/32 |
| KR | 101773511 | | 5/2013 | | |
| KR | 101555603 | B1 * | 9/2015 | | E04C 5/201 |
| KR | 20180022478 | A * | 3/2018 | | E04C 5/18 |
| WO | WO-8800264 | A1 * | 1/1988 | | E04C 5/18 |
| WO | 2015093879 | A1 | 6/2015 | | |
| WO | 2020/051633 | A1 | 3/2020 | | |

OTHER PUBLICATIONS

Szumigala, et al., "Laboratory Tests of New Connectors for Timber-Concrete Composite Structures", Engineering Transactions, vol. 66 No. 2 pp. 161-173, 2018.

Lehan, A., et al., "Development of a Slab-On-Girder Wood-Concrete Composite Highway Bridge", https://www.semanticscholar.org/paper/Development-of-a-Slab-on-Girder-Wood-concrete-Lehan/b7e3353ded024bba066221fdbc79f850e25d7e31, Jul. 23, 2012.

https://www.magnl.store/index.php?main_page=product_info&products_id=234530, "MAKO 1.5" Rebar Chair with Base for Bar Sizes 3-5 (800 pieces per Box), 6 pages, Aug. 2, 2021.

Dias, A., et al., "Design of timber-concrete composite structures", A state-of-the-art report by COST Action FP1402 / WG 4, p. 67, Par. 3.6.3, 2020.

Lyu, Z. et al., "Design of timber-concrete composite (TCC) bridges with under-deck stay cables," Department of Civil and Environmental Engineering, Imperial College London, UK, p. 4, Par. 2.3.1; p. 5, Par. 2.4; Fig. 3, Mar. 18, 2019.

* cited by examiner

FREE BODY DIAGRAM OF
SHEAR TRANSFER THROUGH CONNECTOR

TIMBER-CONCRETE COMPOSITE CONNECTOR AND DUCTILE REINFORCEMENT CHAIR

BACKGROUND

The present disclosure relates generally to floor and roof structure assemblies consisting of a timber substrate and a concrete topping slab which are connected and perform as a composite structural system to resist dead and live loads.

Timber framed buildings often include a concrete topping slab over the timber floor system which enhances the acoustic, vibration, and fire performance of the floor system. The concrete topping slab can be either non-structural or structurally connected to the timber substrate, creating a composite system that further improves the strength, stiffness, and fire performance of the floor system. These systems are generally referred to as "timber-concrete composite" or "TCC" floor and roof systems.

The performance of timber-concrete composite floor and roof systems (strength, stiffness, vibrations, fire resistance, acoustic isolation) is greatly influenced by the connection type between the timber substrate and concrete topping slab. The connection type selected also influences the cost, installation labor, and construction logistics to build TCC floor and roof systems. Common TCC connection types include shear keys in the timber substrate, projecting nail and screw fasteners, mechanically fastened hardware, and adhesive connected hardware. Each of these connection types have trade-offs between performance and cost.

The engineering design of TCC floor and roof systems is typically governed by the composite stiffness of the system. Composite stiffness is influenced by the slip modulus of the timber-concrete connection (horizontal shear deformation at the timber-concrete interface under load). Connectors that have a high slip modulus relative to the joined parts can create rigid connections that maximize structural performance. Increased performance of TCC floor systems reduces the timber materials required which lowers overall cost.

TCC floor and roof systems are statically indeterminant structures. High stiffness connectors attract significant loads during ultimate loading (or strength) events, e.g., maximum potential live loading from occupancy. Connectors that exhibit ductile behavior, e.g., headed steel shear studs that are welded to steel beams and embedded in a concrete deck above the steel beam, can yield predictably during ultimate loading events and minimize the ultimate design forces the connectors resist. Such ductile behavior allows fewer connectors to be used which reduces cost and labor associated to install the system.

Concrete topping slabs are typically reinforced with steel reinforcing bars or welded wire fabric that requires vertical support during wet concrete placement. Reinforcing support chairs typically consist of steel wire or plastic elements that have a geometry that secures the reinforcement when tied to the chair with common steel wire. TCC connectors that can also serve as reinforcing chairs reduce the overall cost of the composite system by eliminating conventional chairs.

Mass-timber floor panels are typically placed by a crane and hoisted with temporary steel lifting hardware fastened to the floor panel. TCC floor connectors can replace temporary hoisting connectors if they have acceptable attachment points and sufficient load capacity. This reduces the time and cost to place mass-timber floor panels.

SUMMARY

Disclosed herein are one or more inventions relating to timber-concrete floor and roof connectors that exhibit high-stiffness (slip modulus) and ductile ultimate loading (or strength) behavior, methods of fabrication and resulting geometry variations, and methods of concrete slab reinforcement chair support. More specifically, disclosed are connectors between timber substrates and composite concrete topping slabs that provide near rigid connections under service loads, exhibit ductile structural behavior under ultimate loads, provide chair support of reinforcement within the topping slab, and can replace temporary hoisting hardware.

The inventive TCC connectors disclosed herein are referred to herein as timber-concrete composite chair ("TC3") connectors or TC3 connectors. They are designed to be embedded in the concrete slab and to secure or connect together the concrete slab and a timber substrate, as described herein.

TC3 connectors can provide high stiffness connections between timber substrates and concrete topping slabs to maximize the performance of TCC systems. The high stiffness connection is provided by a combination mechanical and adhesive connection which is simple to install and more resilient under fire events.

TC3 connectors provide a ductile connection between the timber substrate and concrete topping slab which can yield during ultimate loading level events. System yielding occurs in the relatively thin profiled top bar of the system.

TC3 connectors provide a chair for concrete slab reinforcing support during placement of wet concrete.

TC3 connectors have a consistent geometric module but can vary in length depending on the stiffness and loading requirements of the composite system.

TC3 connectors do not preclude the use of acoustic isolation layers between the timber substrate and concrete topping slab.

TC3 connectors can be installed on many variations of wood, timber, and bamboo substrates. The fasteners of TC3 connectors can also pass through wood, timber, and bamboo substrates and connect wood and timber beam framing members below.

TC3 connectors can be installed off-site in prefabricated panels or on-site as part of conventional building construction methods.

TC3 connectors can replace temporary hoisting hardware for placing mass-timber floor panels in the field.

As used herein:

"Timber" includes wood materials that are solid sawn pieces or heavy timber as well as manufactured products such as cross-laminated timber (CLT), glued-laminated timber panels (GLT), nail-laminated timber (NLT), dowel-laminated timber (DLT), laminated veneer lumber (LVL), mass plywood panels (MPP), glued-laminated beams (Glulam), parallel strand lumber (PSL), and similar products.

"Composite" means a structural system of two different materials such as timber and concrete, which are connected to perform as a singular structural element or system.

"Adhesive" means a product that bond materials together such as timber and steel and include two-part epoxies, acrylic adhesives, all-purpose construction adhesives, adhesive tapes, and similar products.

"Fastener" means a product used to connect timber elements such as conventional screws, self-tapping screws, nails, lag bolts, studs, staples, and similar products.

"Chair" means an object intended to temporarily support reinforcement within a concrete slab during placement of wet concrete.

"Ductility" means the ability for a structural element to yield under load and continue to deform while maintaining the load at point of yielding.

"Slip Modulus" means the connection shear stiffness at the interface of two joined materials, such as the interface between a timber substrate and concrete topping slab. Slip modulus has units of load divided by displacement.

"Service loading" or "service load" means a load up to a service load maximum for which a structure or device is designed to be subjected to during normal use, and are terms commonly understood in the construction industry.

"Ultimate loading" or "ultimate load" means a statistically improbable load above the maximum service load for which a structure or device is designed to be subjected to, and are terms commonly understood in the construction industry. Sometimes these are also referred to as the "factored loads" because they are a predetermined factor greater than the maximum service loads.

In an embodiment, a TC3 connector comprises:

a steel base plate that is rigidly connected to a timber substrate with adhesive and mechanical fasteners, a ductile steel top bar that is connected to or formed from the steel base plate and which supports reinforcing within a concrete topping slab.

In a preferred embodiment, TC3 connectors have a repetitive geometric module that simplifies mass production of connectors with varying lengths.

In a preferred embodiment, TC3 connectors are attached to timber floors (without beams directly below) with short vertical mechanical fasteners.

In a preferred embodiment, TC3 connectors are attached to timber floors and beams directly below with long inclined mechanical fasteners.

In a preferred embodiment, TC3 connectors are connected to the timber substrate in a uniform grid or a non-uniform grid that places connectors based on shear demands within the composite system.

In some embodiments, a non-structural acoustic isolation layer will be provided at the timber-concrete interface but will be discontinuous at the intermittent TC3 connectors.

In some embodiments, the top bar will be formed from the base plate by pressing, stamping, or expanding portions of the base plate metal upward to create the ductile chair geometry.

In some embodiments, the top bar and base plate will be created by bending or folding a single sheet of metal with cut-outs to create the ductile chair geometry.

In some embodiments, the base plate will be fastened with conventional screws, self-tapping screws, nails, lag bolts, studs, staples, and similar products.

In some embodiments, the base plate will be adhered with two-part epoxies, acrylic adhesives, all-purpose construction adhesives, adhesive "peel and stick" tapes, and similar products.

In some embodiments, alternate bio-based materials such as bamboo will be the substrate in lieu of timber.

In some embodiments, alternate concrete topping slabs such as lightweight and gypsum concretes will be connected to a timber substrate.

In some embodiments, reinforcing within the topping slab will consist of steel deformed reinforcing bars, welded wire fabric, post-tensioning cables, carbon fiber rods, glass fiber rods, or basalt rods.

In some embodiments, the connector may be comprised of reinforced plastic composites in lieu of steel.

Other systems, methods, features, and advantages of the one or more disclosed inventions will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the system disclosed herein, and together with the description, explain the advantages and principles of the disclosed system. In the drawings.

DETAILED DESCRIPTION

Reference will now be made in detail to one or more implementations or embodiments using one or more timber concrete composite connectors consistent with the principles disclosed herein with reference to the accompanying drawings.

Figure 1A:
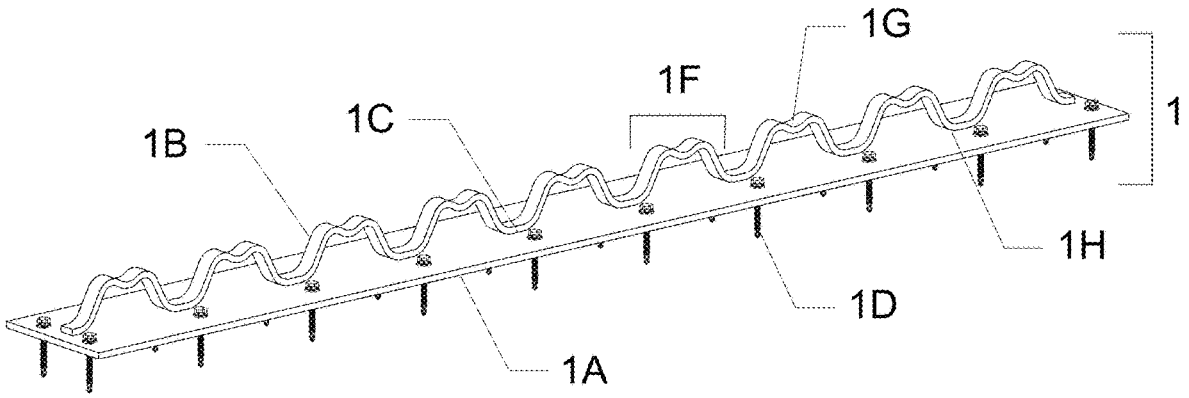
FIG. 1A is an isometric view of a first embodiment of a TC3 timber-concrete composite connector with ductile reinforcement chair embodying principles presented herein.

FIG. 1A is an isometric view of a first TC3 connector 1 with a ductile reinforcement chair. The TC3 connector 1 comprises a steel base plate 1A is attached to a timber substrate with a combination of adhesive (not shown) on the bottom surface of the plate 1A and mechanical fasteners 1D which extend through holes 1E (shown in other Figs.) in the plate. Steel top bar 1B has a curved profile with a repetitive module 1F which provides a chair support for reinforcement bars 2A and 2B (shown in other Figs.) and connects to a concrete topping slab through bonding and direct bearing. The TC3 connector 1, and the other TC3 connectors described herein, and embedded within the poured concrete topping slab. Steel top bar 1B is connected and secured to steel base plate 1A by structural welds 1C. The overall length of the connector and parts 1A and 1B is variable and can be any length required by engineering design.

The base plate preferably has an overall planar configuration, or at least an overall planar bottom surface, and thereby has an effective plane. The through holes in this embodiment have longitudinal axes that are orthogonal to the effective plane of the base plate. In other embodiments described below, the longitudinal axes preferably are oriented other than orthogonal to the effective plane of the base plate.

The adhesive or adhesives used to secure the base plate to the timber substrate preferably comprise two-part epoxies, acrylic adhesives, all-purpose construction adhesives, adhesive tapes, and similar products as required by engineering design.

The curved profile preferably is continuously smooth to avoid points of weakness and to simplify manufacturing. The module 1F includes a dip or chair 1G for receiving and supporting a reinforcing bar as will be shown in other figures. Two modules 1F are separated by a reverse curve 1H. Therefore the bar 1B has an overall undulating or sinusoidal profile.

The bar 1B is illustrated as a deformed rectangular bar, but could have any suitable cross-sectional shape such a circular cross-sectional shape. The bar, for reasons explained below, preferably is of a grade of steel that exhibits good plastic deformation behavior or ductility under ultimate loads. The steel materials of the bar can consist of common carbon steel such as ASTM A36 and ASTM A572 or stainless steel such as ASTM A316.

Figure 1B:
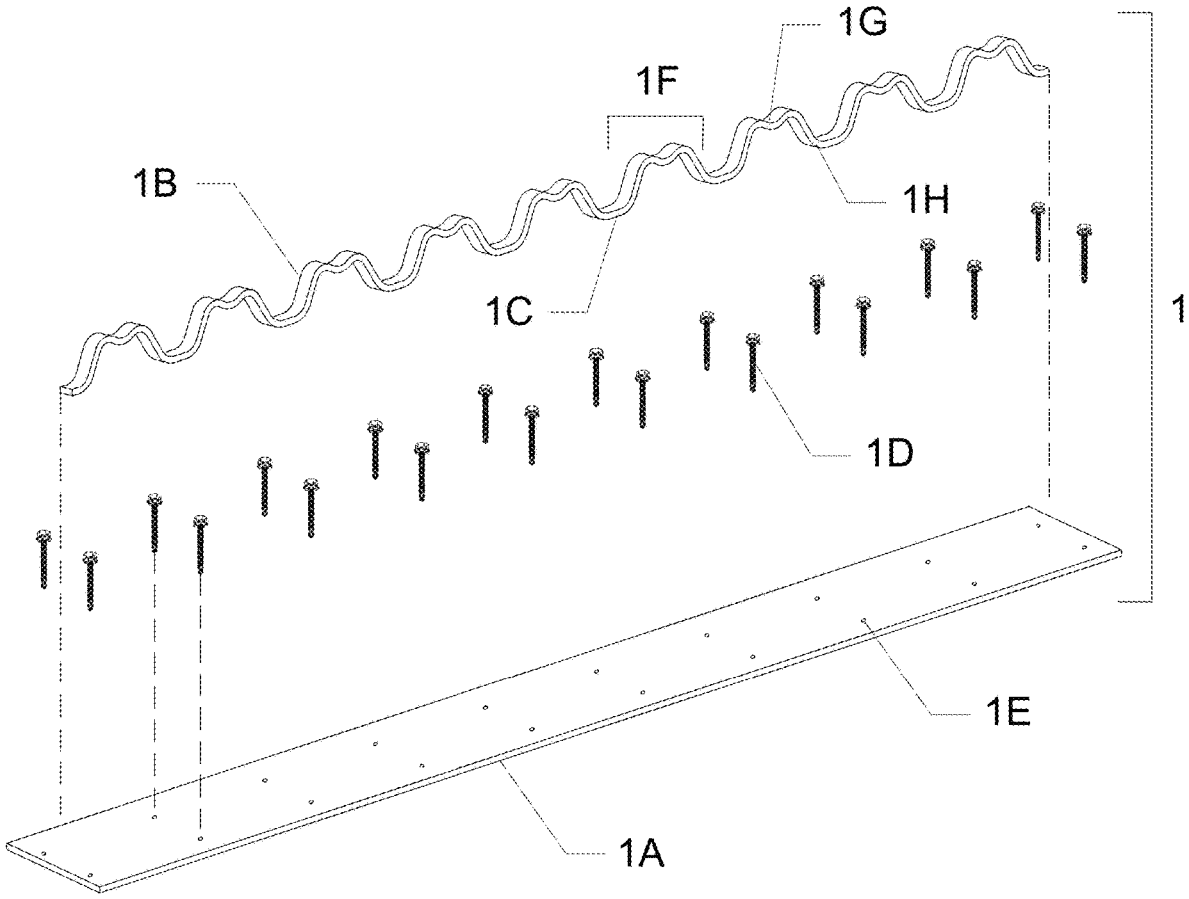
FIG. 1B is an exploded view of FIG. 1A.

FIG. 1B is an exploded view of the TC3 connector 1 of FIG. 1A. showing steel base plate 1A, ductile steel top bar 1B, structural welds 1C, mechanical fasteners 1D, and through holes 1E.

Figure 2A:
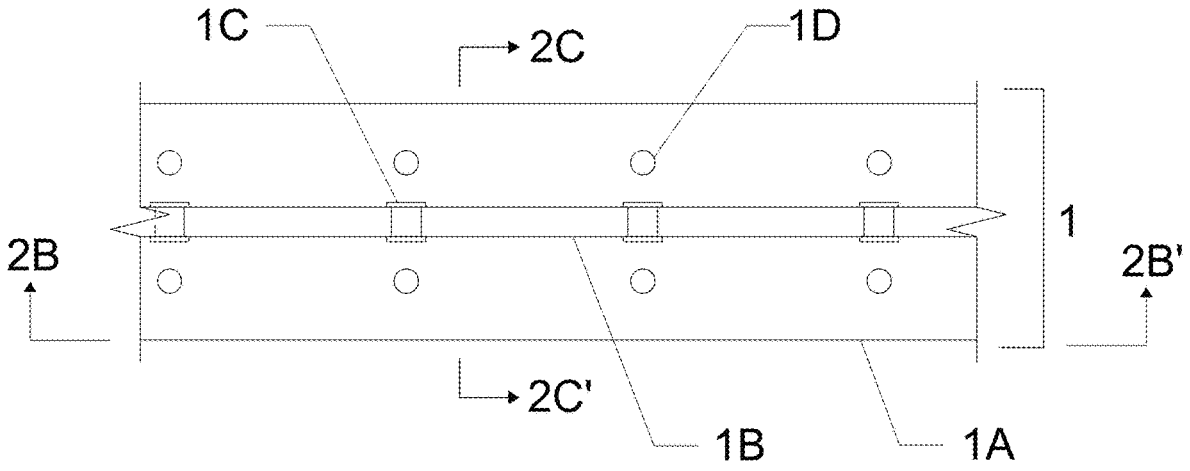
FIG. 2A is a plan view of FIG. 1A.

FIG. 2A is a plan view of the TC3 connector 1 of FIG. 1A. showing a top side of steel base plate 1A, ductile steel top bar 1B, structural welds 1C on both sides of the top bar 1B, and mechanical fasteners 1D. In this embodiment, the mechanical fasteners 1D are shown as screws. However, alternatively, the mechanical fasteners could be nails as shown in another embodiment below. Other types of mechanical fasteners may be used as may be appropriate to meet a particular structural design.

Figure 2B:
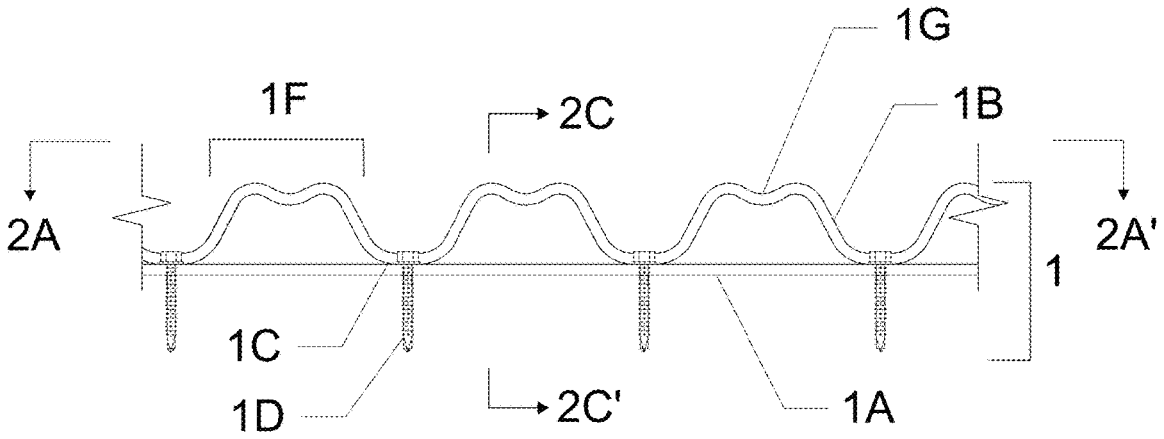
FIG. 2B is an elevation view of FIG. 1A.

FIG. 2B is an elevation view of the TC3 connector 1 of FIG. 1A taken along the line 2B-2B of FIG. 2A.

Figure 2C:
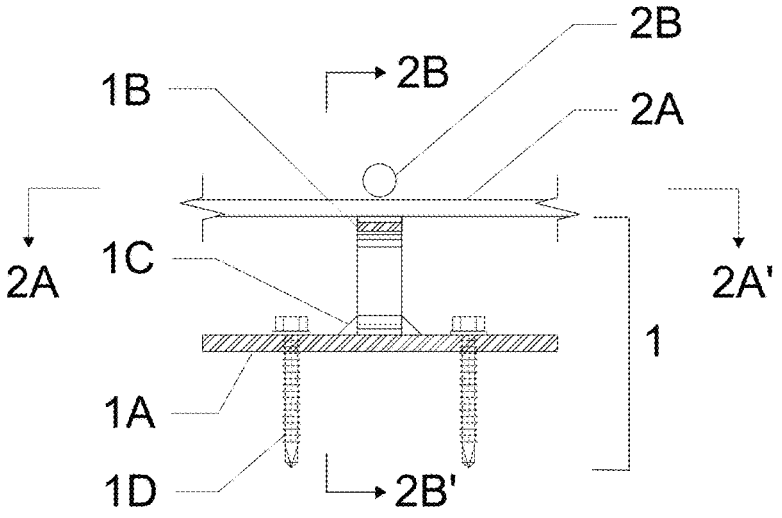
FIG. 2C is a section view of FIG. 1A.

FIG. 2C is a section view of the TC3 connector 1 of FIG. 1A taken along the line 2C-2C of FIG. 2A. FIG. 2C also illustrates a first reinforcement bar 2A received in the chair 1G of module 1F. The first reinforcement bar 2A extends in a first direction that crosses the direction of the extend of the top bar 1B and the TC3 connector 1. Received on top of the first reinforcement bar 2A is a second reinforcement bar 2B. The second reinforcement bar 2B extends in a direction that crosses the direction of the extent of the first reinforcement bar 2A. In a preferred embodiment, the first direction and the second direction are orthogonal to each other. However, in other embodiments, they are not orthogonal to each other. Also, preferably the direction of the extent of the first reinforcement bar 2A is orthogonal to the direction of the extent of the TC3 connector 1. However, in other embodiments, the direction of the extent of the first reinforcement bar 2A is not orthogonal to the extent of the direction of the TC3 connector 1. First reinforcement bar 2A may be second to the top bar 2B is placed on top of the top bar 1B and secured with a conventional wire tie. Second reinforcement bar 2B may also be secured to the first reinforcement bar 2A and/or the top bar 1B using the same wire tie or one or more other wire ties.

Figure 3A:
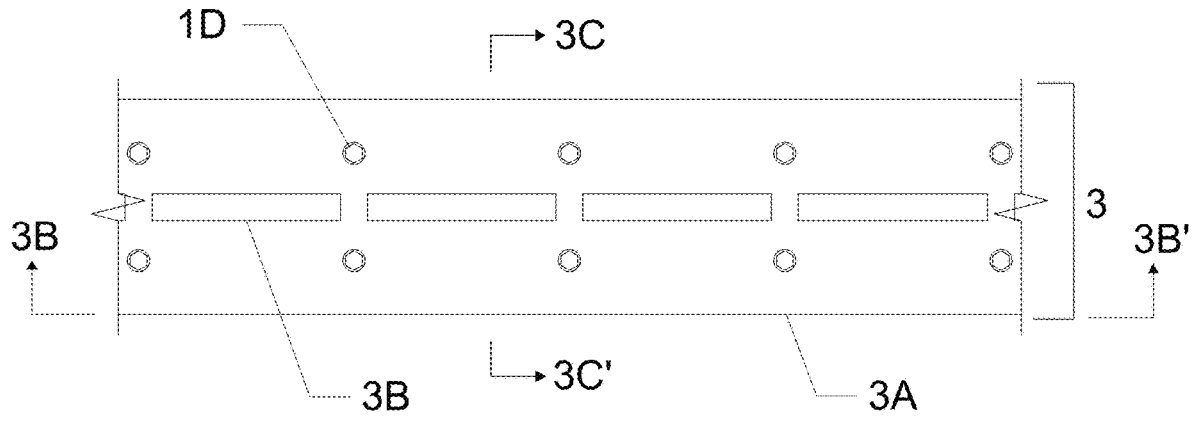
FIG. 3A is a plan view of a second embodiment of a TC3 timber-concrete composite connector with ductile reinforcement chair embodying principles presented herein where the top bar is pressed, stamped, or expanded from the metal of the base plate.

FIG. 3A is a plan view of a second TC3 connector 3 which is a fabrication alternate of the TC3 connector 1. In the TC3 connector 3, the top bar 3B is pressed, stamped, or expanded from the metal of the base plate 3A. As a result, welding is not required to join the base plate 3A and top bar 3B as these parts are formed from the same plate and unitary. Preferably, mechanical fasteners 3D are positioned in the continuous portion of the base plate 3A between modules 3F.

Figure 3B:
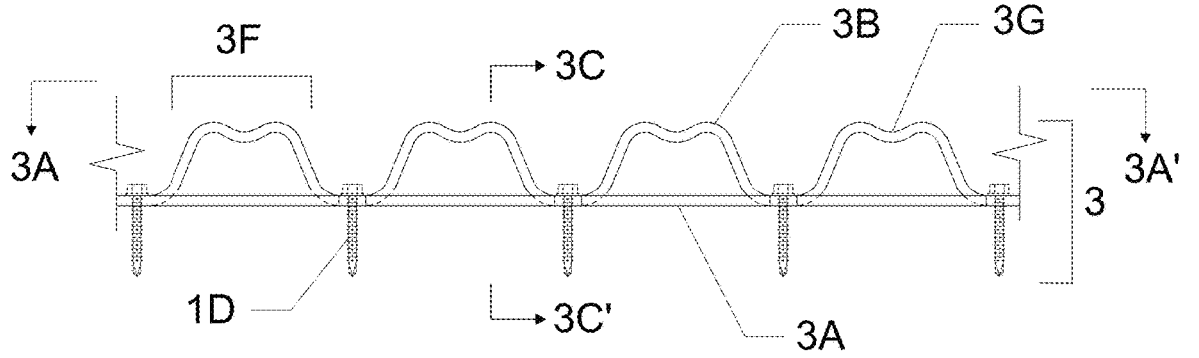
FIG. 3B is an elevation view of the second embodiment of a TC3 connector.

FIG. 3B is an elevation view of the second TC3 connector 3 and illustrates where the top bar 3B is pressed, stamped, or expanded from the metal of the base plate 3A. Each module 3F includes a chair 3G for receipt of a first reinforcement bar 2A as described above.

Figure 3C:
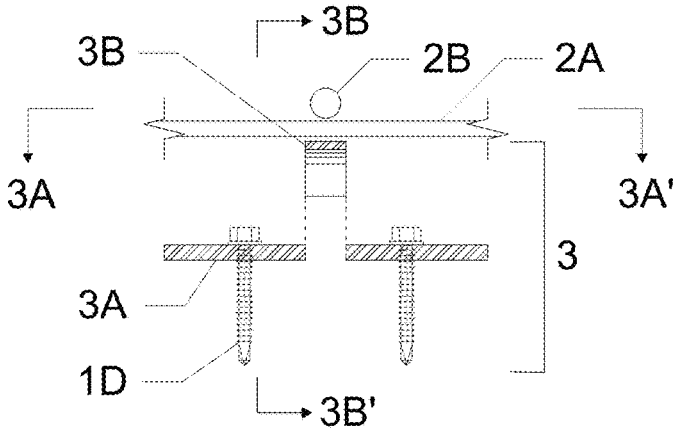
FIG. 3C is a section view of the second embodiment of a TC3 connector.

FIG. 3C is a section view of the second TC3 connector 3 and illustrates where the top bar 3B is pressed, stamped, or expanded from the metal of the base plate 3A. This section view shows the removed area from base plate 3A to form top bar 3B. This view also show the receipt and positioning of the first transverse reinforcement bar 2A and the second longitudinal reinforcement bar 2B as described above. The second longitudinal reinforcement bar 2B may also be secured to the first reinforcement bar 2A and/or the top bar 3B using the same wire tie or one or more other wire ties.

Figure 4A:
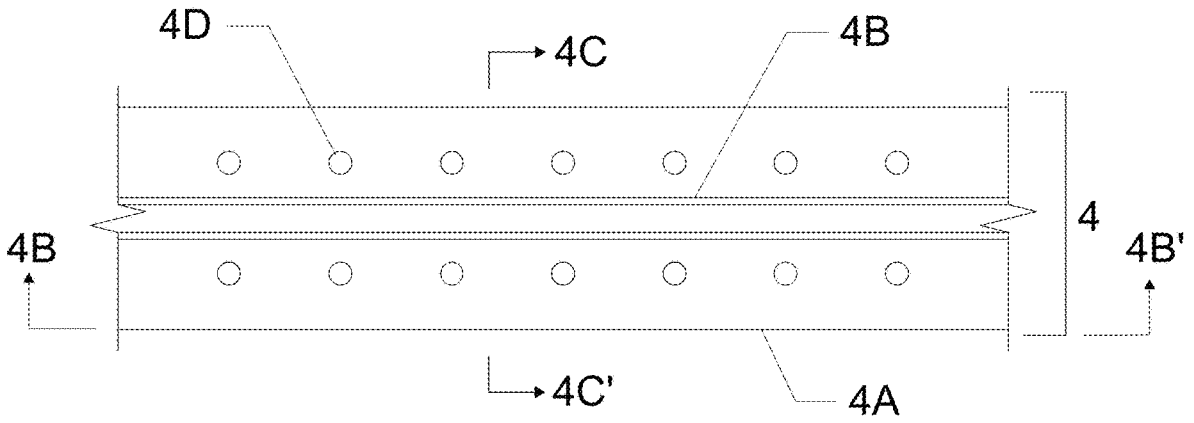
FIG. 4A is a plan view of a third embodiment of a TC3 timber-concrete composite connector with ductile reinforcement chair embodying principles presented herein where the top bar and base plate are created by cutting and bending or folding a single sheet of metal into the geometry of a base plate and top bar.

FIG. 4A is a plan view of a third TC3 connector 4 where the top bar 4B and base plate 4A are created by cutting and then bending or folding a single sheet of metal into the geometries of the base plate 4A and top bar 4B. The base plate 4A and top bar 4B are formed from a continuous sheet. The base plate 4A is connectable or securable, at least in part, to timber substrate with an adhesive (not shown) and mechanical fasteners 4D.

Figure 4B:
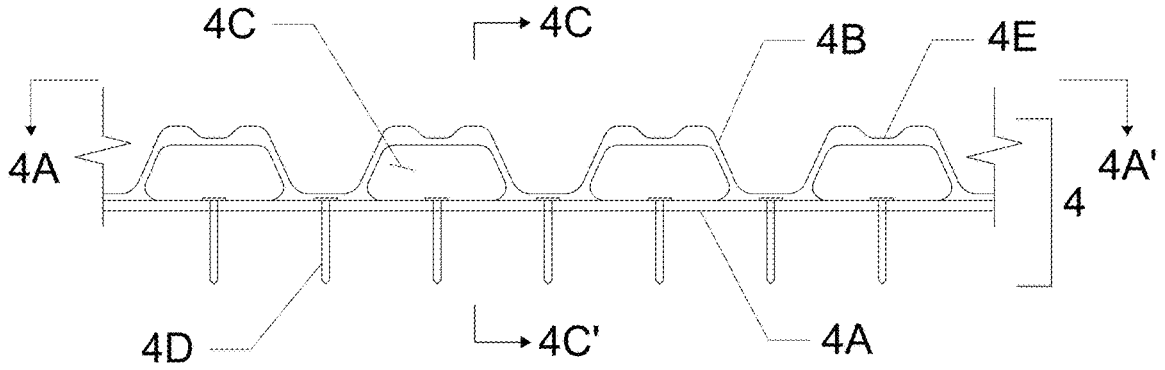
FIG. 4B is an elevation view of a third embodiment of a TC3 connector.

FIG. 4B is an elevation view of the third TC3 connector 4 where the top bar 4B and base plate 4A are created by cutting and then bending or folding a single sheet of metal into the geometries of the base plate 4A and top bar 4B. In this view, cut patterns 4C which provide the ductile behavior to the top bar 4B are readily seen and understood.

Figure 4C:
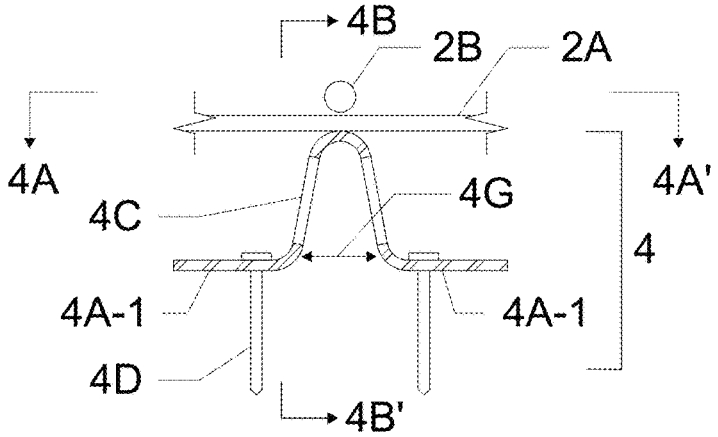
FIG. 4C is a section view of the third embodiment of a TC3 connector.

FIG. 4C is a section view of the third TC3 connector 4 where the top bar 4B and base plate 4A are created by cutting and then bending or folding a single sheet of metal into the geometries of the base plate 4A and top bar 4B. The gap between near vertical sections shown in this view, i.e, the distance 4G between the opposed base plate sections 4A-1 and 4A-2 is variable depending on manufacturing preferences or limitations.

As can be appreciated from FIGS. 4A-4B, preferably, a metal plate is first provided with two parallel rows of cut patterns or cut outs 4C positioned on opposite sides of a line of symmetry in the metal plate. Thereafter the, the metal plate is bent or folded along the line of symmetry to a desired bended or folded degree. Preferably, as shown, the bend does not include a sharp crease as that could introduce an undesired weakness or point of failure in the top bar 4B. Before or after such bending or folding, the outer edges of the metal plate can be bent or folded to form the parallel base plate sections 4A-1 and 4A-2 and a section that defines the top bar 4B. Again, this folding or bending is such that a sharp crease is not created so as to avoid introducing an undesired weakness or point of failure. Thereafter, the section that defines the top bar 4B can be cut or deformed at each module 4E to include a concavity or depression that defines a chair 4E.

As with the prior TC3 connectors, each chair 4E is formed so as to be capable of receiving a first reinforcement bar 2A which can be secured to the top bar 4B with a wire tie as described above. The second reinforcement bar 2B may also be secured to the first reinforcement bar 2A and/or the top bar 4B using the same wire tie or one or more other wire ties.

As illustrated, as an alternative, the mechanical fasters 4D can be nails, rather than screws.

Figure 5A:
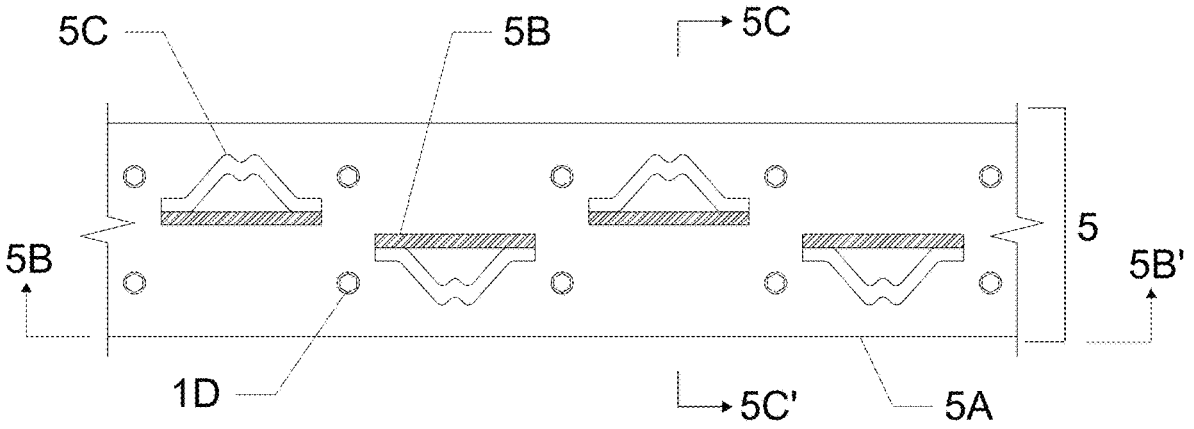
FIG. 5A is a plan view of a forth embodiment of a TC3 timber-concrete composite connector with ductile reinforcement chair embodying principles presented herein where the top bar geometry is partially cut from the base plate and bent upward to the final position.

FIG. 5A is a plan view of a fourth TC3 connector 5 which is a fabrication alternate of the TC3 connector 1. In the TC3 connector 5, the top bar 5B is partially cut in pattern 5C and then bent upward from the metal of the base plate 5A. As a result, welding is not required to join the base plate 5A and top bar 5B as these parts are formed from the same plate and unitary. As with prior TC3 connectors, the base plate is connected to a mass-timber substrate with adhesives (not shown) and mechanical fasteners 1D.

Figure 5B:
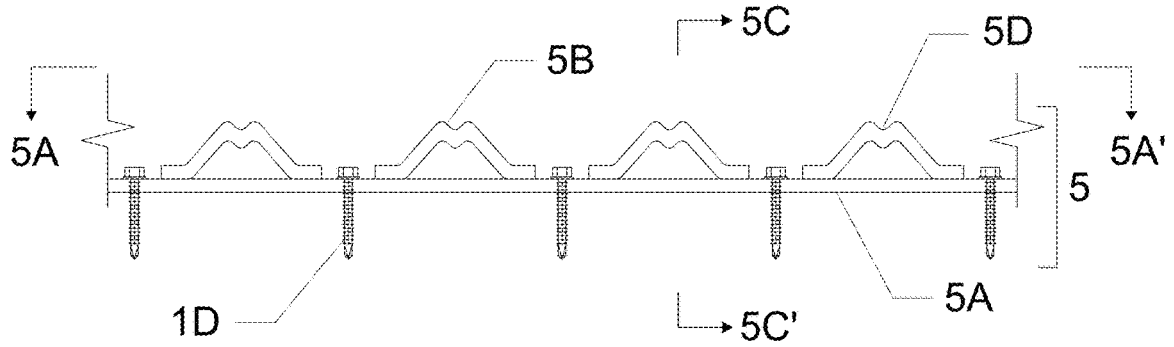
FIG. 5B is an elevation view of the forth embodiment of a TC3 connector.

FIG. 5B is an elevation view of the fourth TC3 connector 5 showing elements described above including the profile of top bar 5B. The profile of the top bar has depressions 5C which provide reinforcing chair support.

Figure 5C:
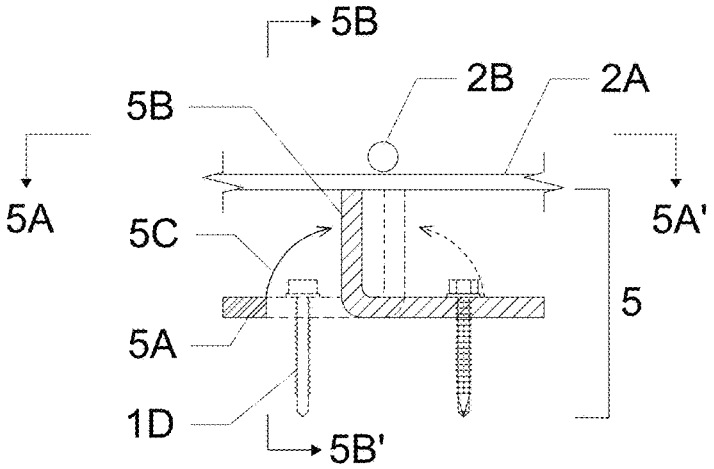
FIG. 5C is a section view of the forth embodiment of a TC3 connector.

FIG. 5C is a section view of the fourth TC3 connector 5 showing elements described above as well as first reinforcement bar 2A which can be secured to the top bar 5B with wire ties. The second reinforcement bar 2B can be secured to 2A with wire ties.

Figure 6A:
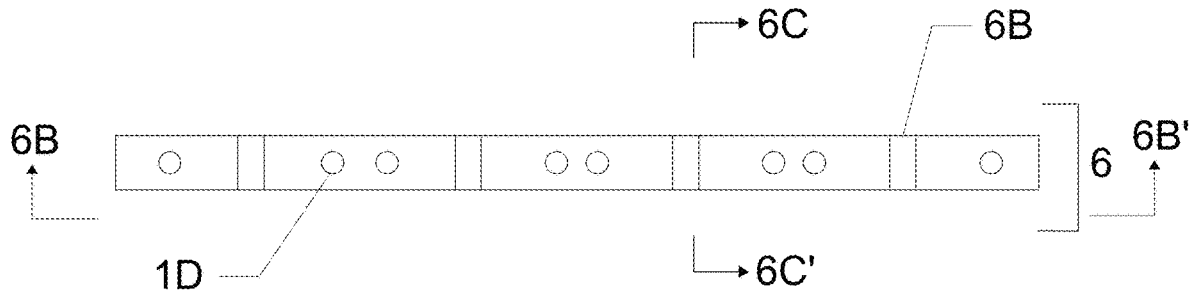
FIG. 6A is a plan view of a fifth embodiment of a TC3 timber-concrete composite connector with ductile reinforcement chair embodying principles presented herein where the top bar is embedded within a shear key in the mass-timber substrate in lieu of a base plate.

FIG. 6A is a plan view of a fifth TC3 connector 6 which is a fabrication alternate of the TC3 connector 1. In the TC3 connector 6, the top bar 6B is a formed with a bent corrugated metal profile. The lower flat section of the corrugated profile is placed within a recessed shear key 5A of the mass-timber panel below. As a result, a base plate is not required to achieve the engineering requirements of the connector. As with prior TC3 connectors, the connector is connected to the mass-timber substrate with adhesives within the shear key 5A (not shown) and mechanical fasteners 1D.

Figure 6B:
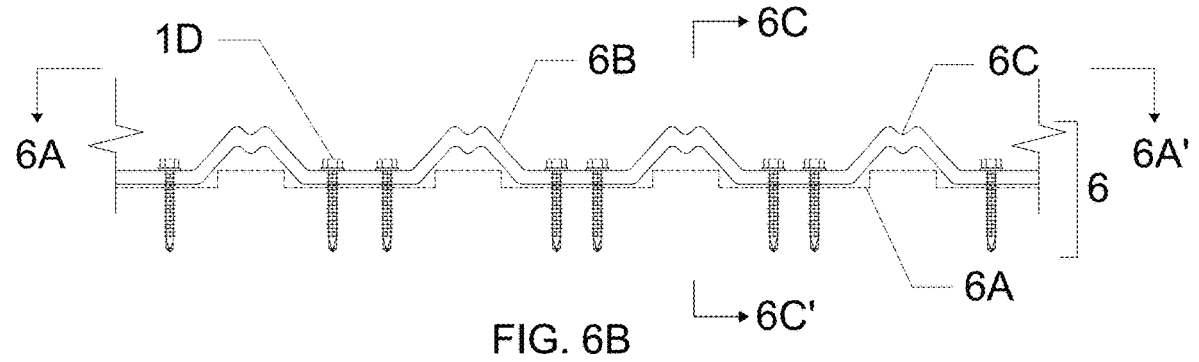
FIG. 6B is an elevation view of the fifth embodiment of a TC3 connector.

FIG. 6B is an elevation view of the fifth TC3 connector showing elements described above including the profile of top bar 6B. The profile of the top bar has depressions 6C which provide reinforcing chair support.

Figure 6C:
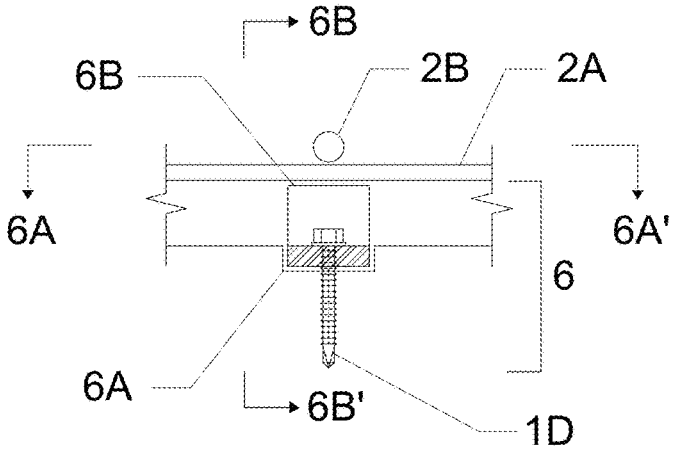
FIG. 6C is a section view of the fifth embodiment of a TC3 connector.

FIG. 6C is a section view of the fifth TC3 connector 6 showing elements described above as well as first reinforcement bar 2A which can be secured to the top bar 5B with wire ties. The second reinforcement bar 2B can be secured to 2A with wire ties.

In FIGS. 7-16, one or more TC3 connectors with a ductile reinforcement chair embodying principles presented herein are used to illustrate the positioning and use of TC3 connectors disclosed herein on CLT substrates in accordance with principles disclosed herein. It can readily be appreciated how the same principles apply to all of the TC3 connectors disclosed herein as well as others embodying the principles disclosed herein.

Figure 7A:
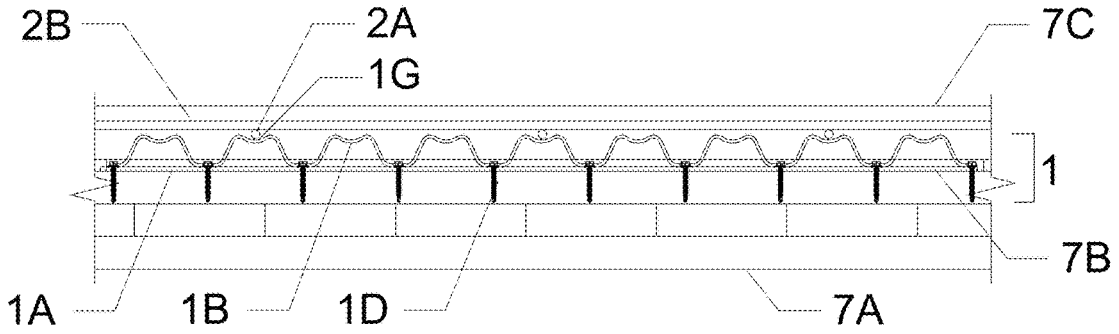
FIG. 7A is a section view of a TC3 connector embodying principles disclosed herein installed on a CLT substrate and supporting reinforcement bars with acoustic isolation mat between the timber and concrete.

FIG. 7A is a section view of a TC3 connector 1 installed on a CLT substrate 7A and supporting reinforcement bars 2A and 2B with acoustic isolation mat 7B between the timber layer 7D and concrete topping slab 7C.

Figure 7B:
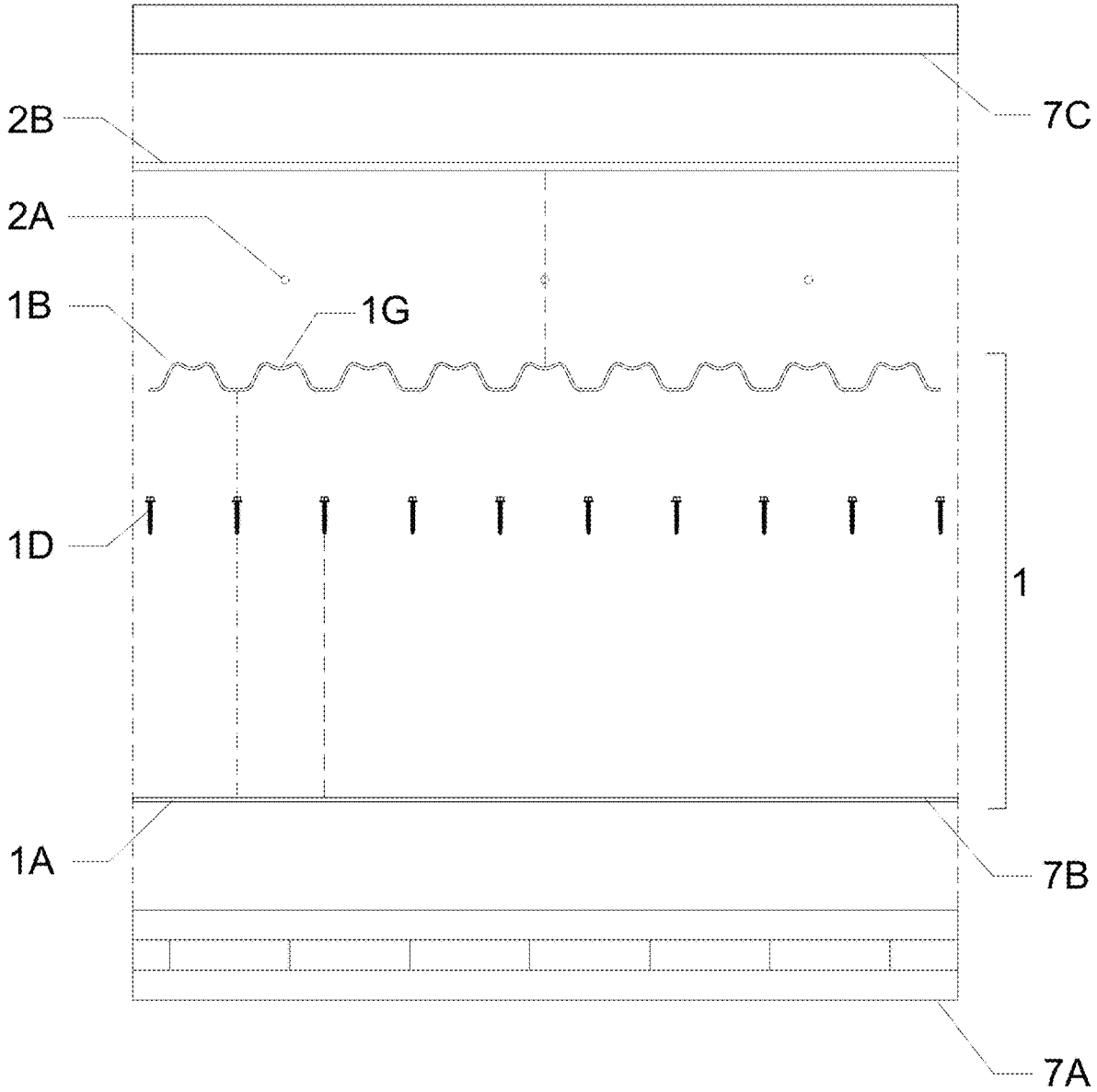
FIG. 7B is an exploded section view of FIG. 7A.

FIG. 7B is an exploded view of FIG. 7A.

Figure 8:
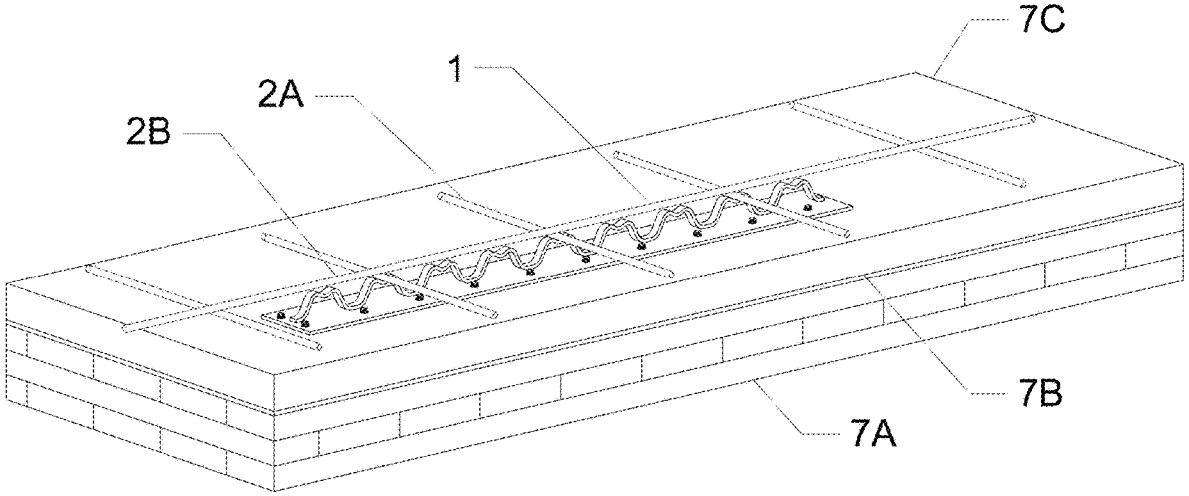
FIG. 8 is an isometric view of a TC3 connector embodying principles disclosed herein installed on a typical portion of CLT substrate and supporting reinforcement bars with acoustic isolation mat between the timber and concrete.

FIG. 8 is an isometric view of a TC3 connector 1 installed on a typical portion of a CLT substrate 7A and supporting reinforcement bars 2A and 2B with acoustic isolation mat 7B between the timber layer 7A and concrete topping slab 7C.

Figure 9:
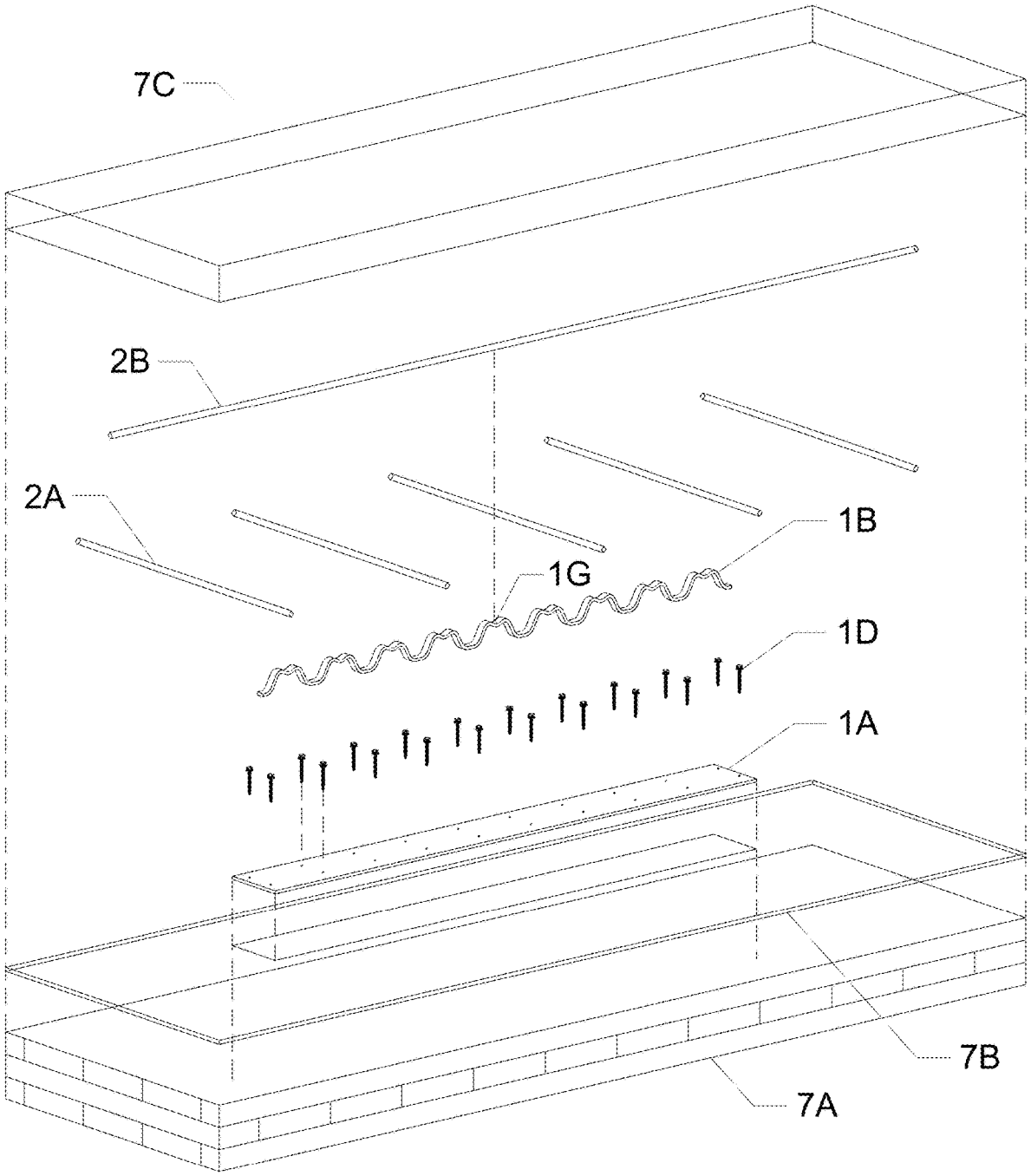
FIG. 9 is an exploded view of FIG. 8.

FIG. 9 is an exploded view of FIG. 8 showing CLT substrate 7A, optional acoustic layer 7B, steel base plate with adhesives 1A, mechanical fasteners 1D, ductile steel top bar 1B, concrete reinforcement bars 2A and 2B, and concrete topping slab 7C.

Figure 10:
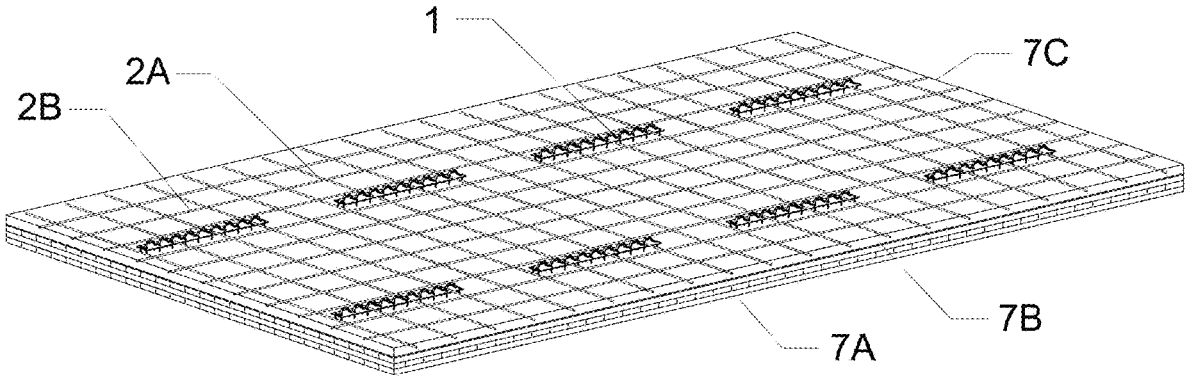
FIG. 10 is an isometric view of a uniform grid of TC3 connectors embodying principles disclosed herein installed on a panel of an overall floor system.

FIG. 10 is an isometric view of a uniform grid of TC3 connectors 1 installed on a panel of an overall floor system showing CLT substrate 7A, optional acoustic layer 7B, concrete topping slab 7C, array of TC3 connectors 7D, and concrete reinforcement bars 2A and 2B.

Figure 11A:
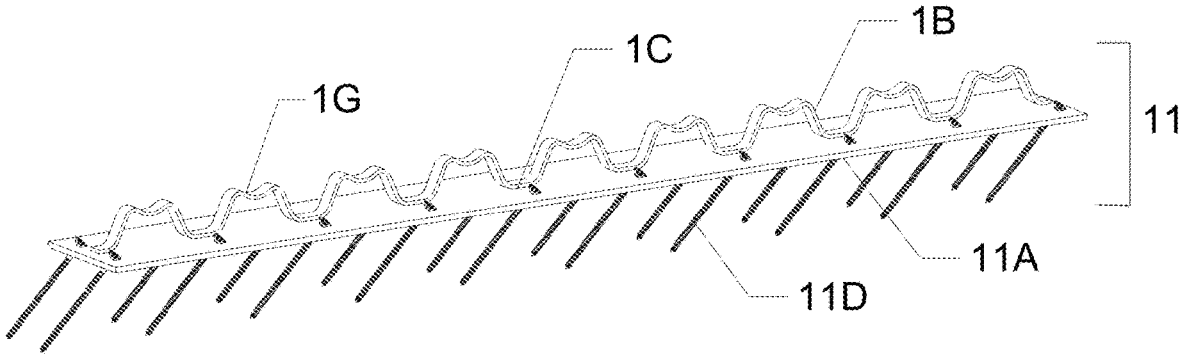
FIG. 11A is an isometric view of a TC3 connector embodying principles disclosed herein with inclined screws for connecting through a timber deck to a timber beam below.

FIG. 11A is an isometric view of a TC3 connector 11 with inclined screws 11D for connecting through a timber deck to a timber beam below (not shown). Steel top bar 1B is connected to a steel base plate 11A with structural welds 1C. The base plate 11A is connected to a timber substrate with adhesives (not shown) and diagonal/inclined self-tapping screws 11D. The holes for base plate 11A for screws 11D preferably are inclined (i.e., oriented other than orthogonal) relative to the effective plane of the base plate and may have a countersunk or similar geometry for a tight fit with the screw head.

Figure 11B:
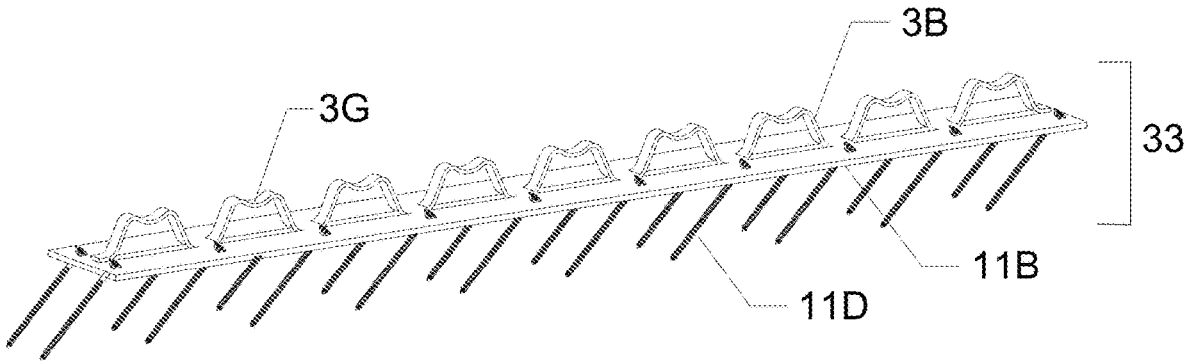
FIG. 11B is an isometric view of the second of a TC3 timber-concrete composite connector with ductile reinforcement chair embodying principles presented herein where the top bar is pressed, stamped, or expanded from the metal of the base plate.

FIG. 11B is an isometric view of a TC3 connector 33 where the top bar is pressed, stamped, or expanded from the metal of the base plate. Steel top bar 3B is formed from base plate 11B. The base plate 11B is connected to a timber substrate (not shown) with adhesives (not shown) and diagonal/inclined self-tapping screws 11D. The holes for base plate 11B for screws 11D preferably are inclined (i.e., oriented other than orthogonal) relative to the effective plane of the base plate and may have a countersunk or similar geometry for a tight fit with the screw head.

Figure 11C:
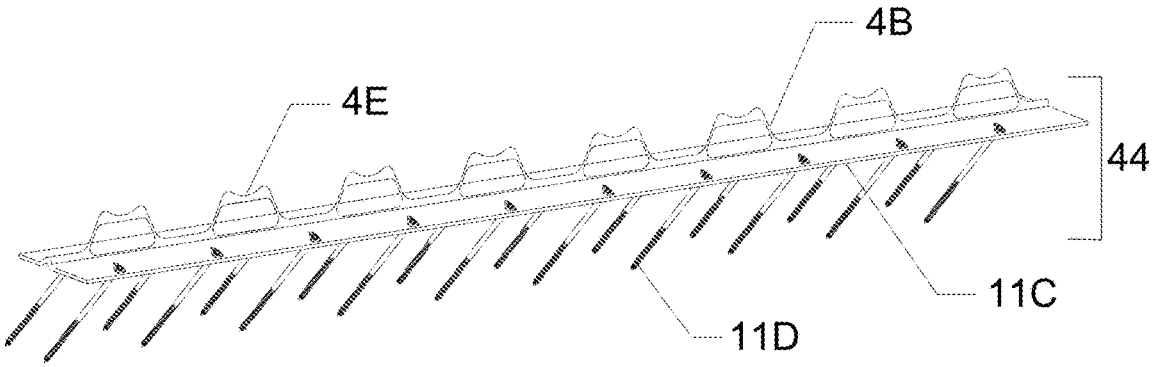
FIG. 11C is an isometric view of the third embodiment of a TC3 timber-concrete composite connector with ductile reinforcement chair embodying principles presented herein where the top bar and base plate are created by cutting and bending or folding a single sheet of metal into the geometry of a base plate and top bar.

FIG. 11C is an isometric view of a TC3 connector 44 where the top bar and base plate are created by cutting and bending or folding a single sheet of metal into the geometry of a base plate and top bar. Steel top bar 4B and base plate 11C are formed by a single bent/folded plate with cutouts as described above. The base plate 11C is connected to a timber substrate (not shown) with adhesives (not shown) and diagonal/inclined self-tapping screws 11D. The holes for base plate 11C for screws 11D preferably are inclined (i.e., oriented other than orthogonal) relative to the effective plane of the base plate and may have a countersunk or similar geometry for a tight fit with the screw head.

Figure 12A:
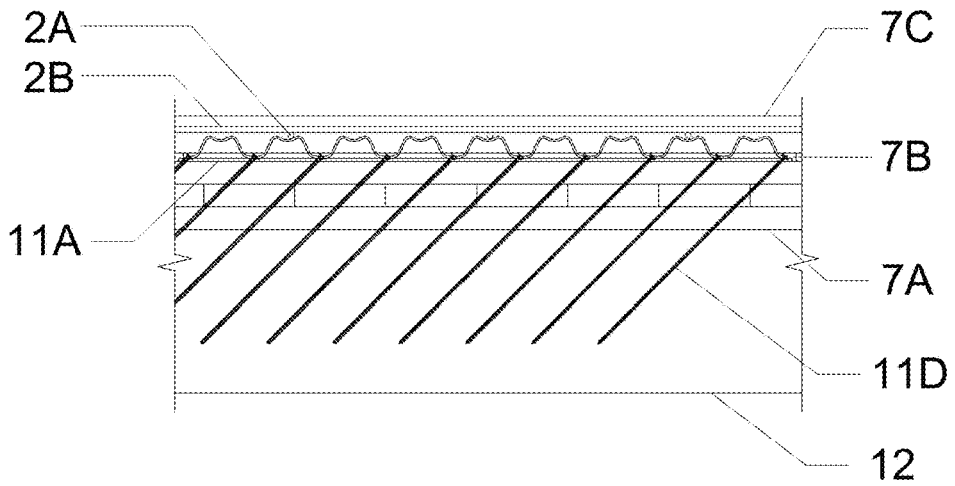
FIG. 12A is an elevation view of the first embodiment of a TC3 connector embodying principles disclosed herein with inclined screws attached to the top of a CLT deck substrate and connecting through to the timber beam below.

FIG. 12A is an elevation view of a TC3 connector 11 with inclined screws 11D attached to the top of a CLT deck substrate 7A and connecting through to the timber beam 12 below. The TC3 connector 11 supports concrete reinforcing bars 2A and 2B. An optional acoustic isolation layer 7B is at the interface of timber and concrete.

Figure 12B:
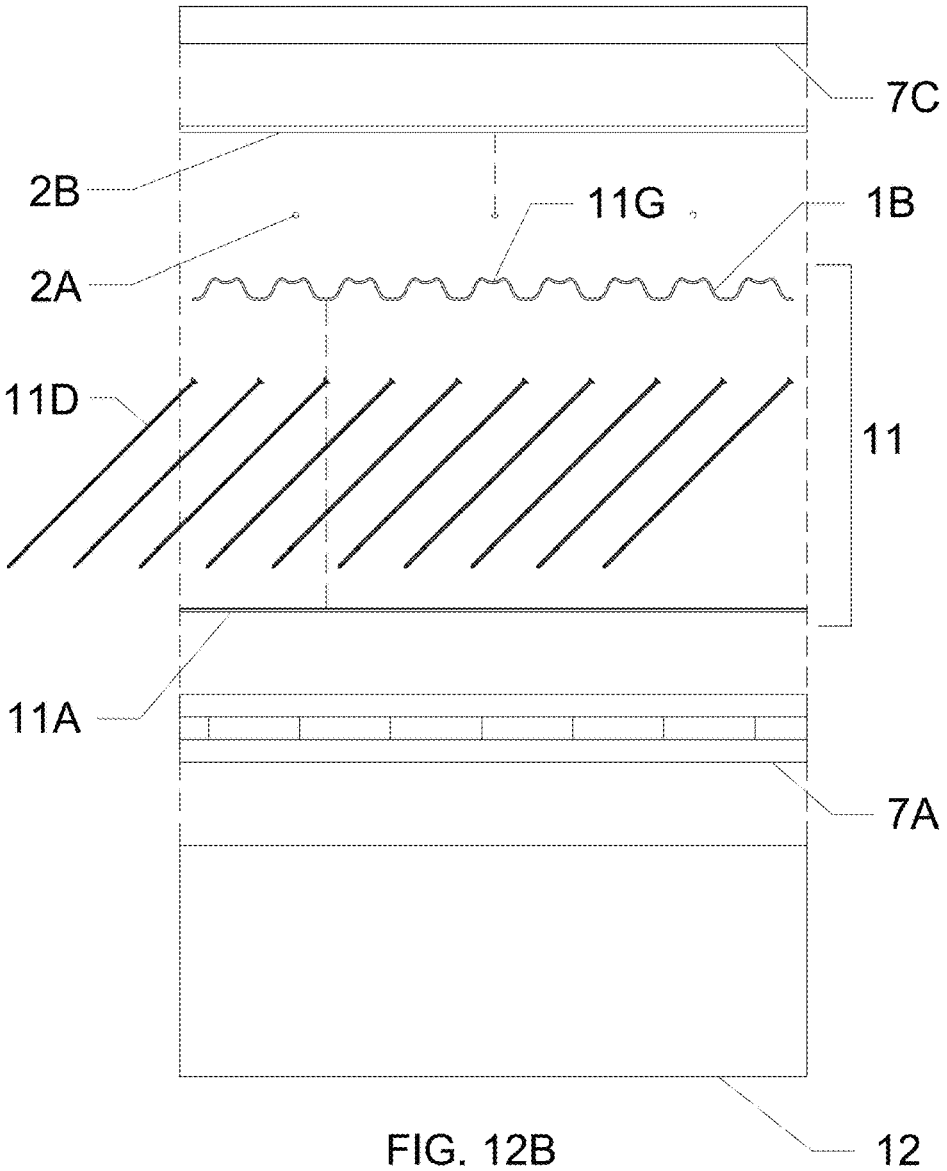
FIG. 12B is an exploded view of FIG. 12A.

FIG. 12B is an exploded view of FIG. 12A.

Figure 13:
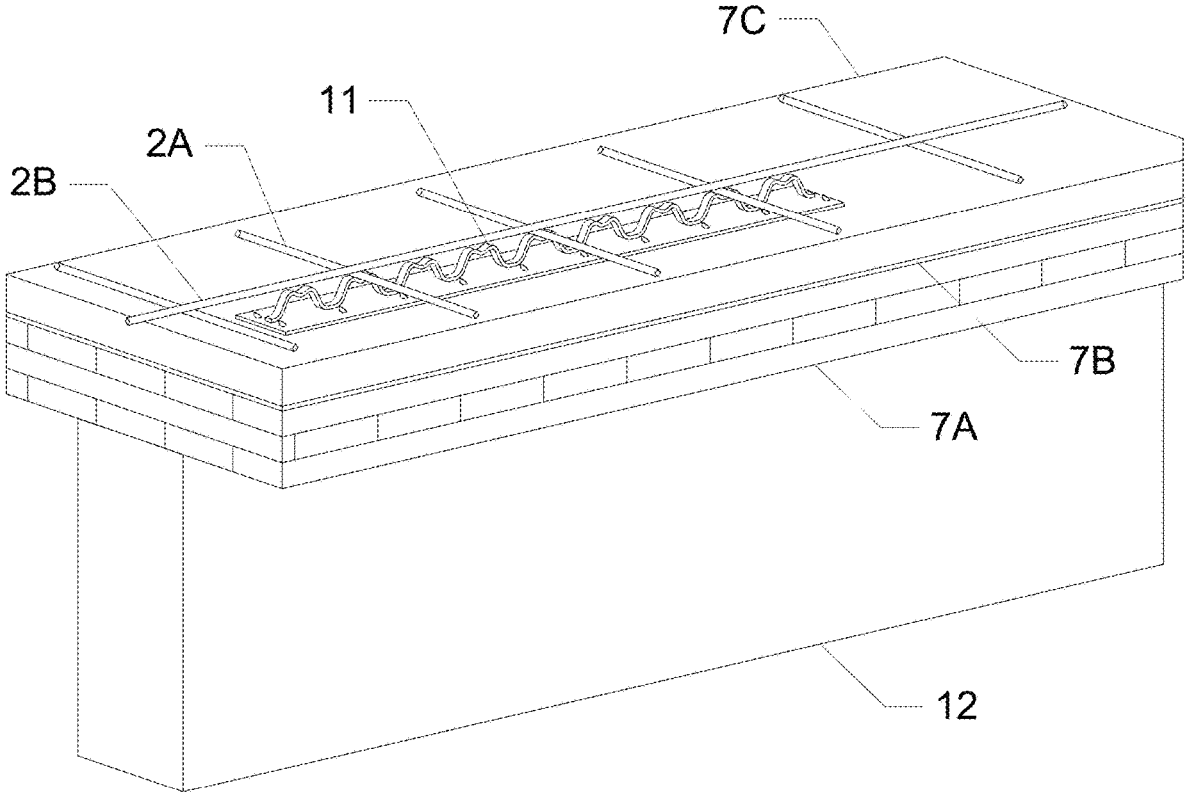
FIG. 13 is an isometric view of the first embodiment of a TC3 connector embodying principles disclosed herein with inclined screws attached to the top of a CLT deck substrate and connecting through to the timber beam below.

FIG. 13 is an isometric view of the TC3 connector 11 with inclined screws 11D attached to the top of a CLT deck substrate 7A and connecting through to the timber beam 12 below.

Figure 14:
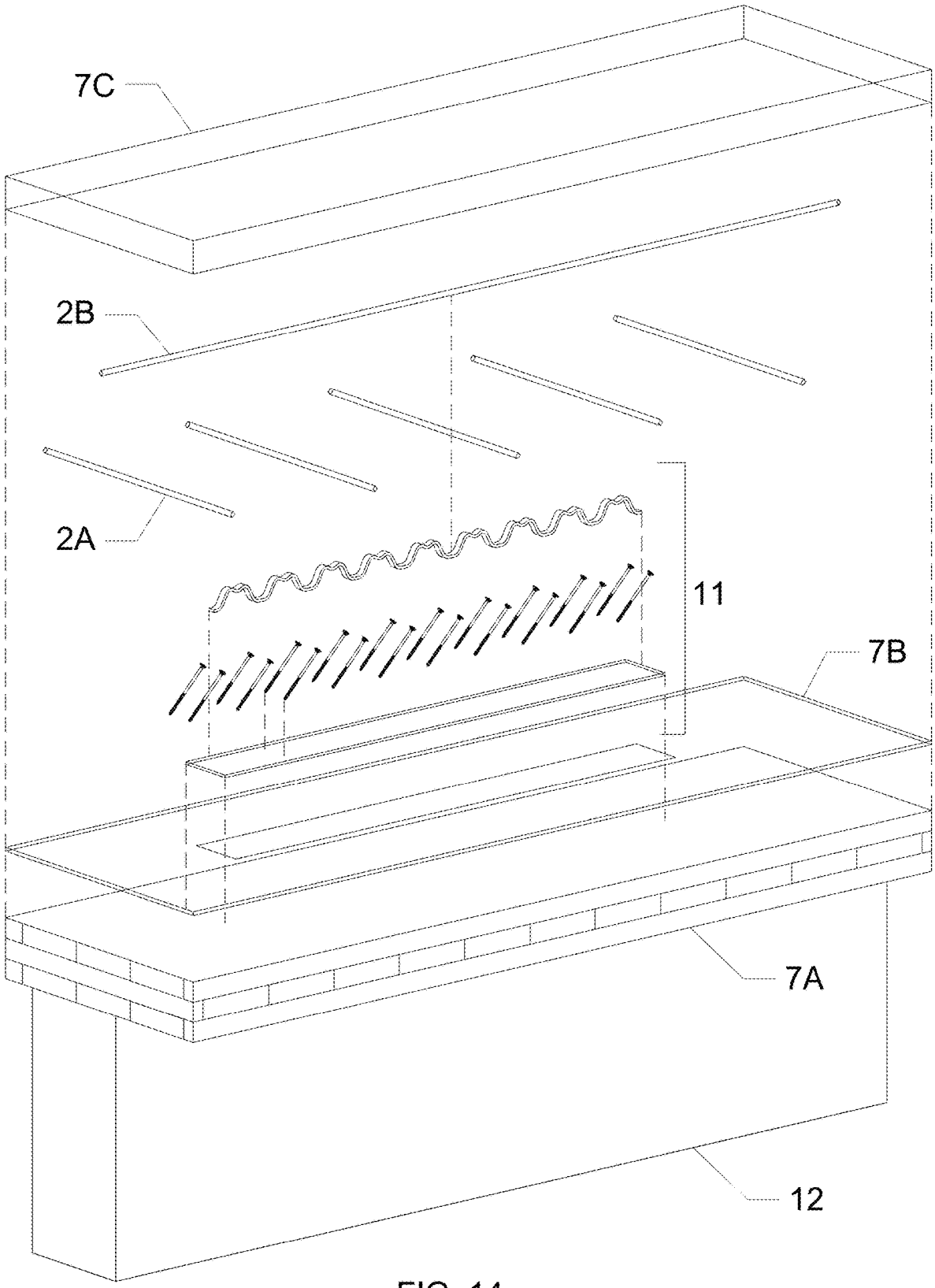
FIG. 14 is an exploded view of FIG. 13.

FIG. 14 is an exploded view of FIG. 11 showing the TC3 connector 11 with inclined screws 11D attached to the top of a CLT deck substrate 7A and connecting through to the timber beam 12 below.

Figure 15:
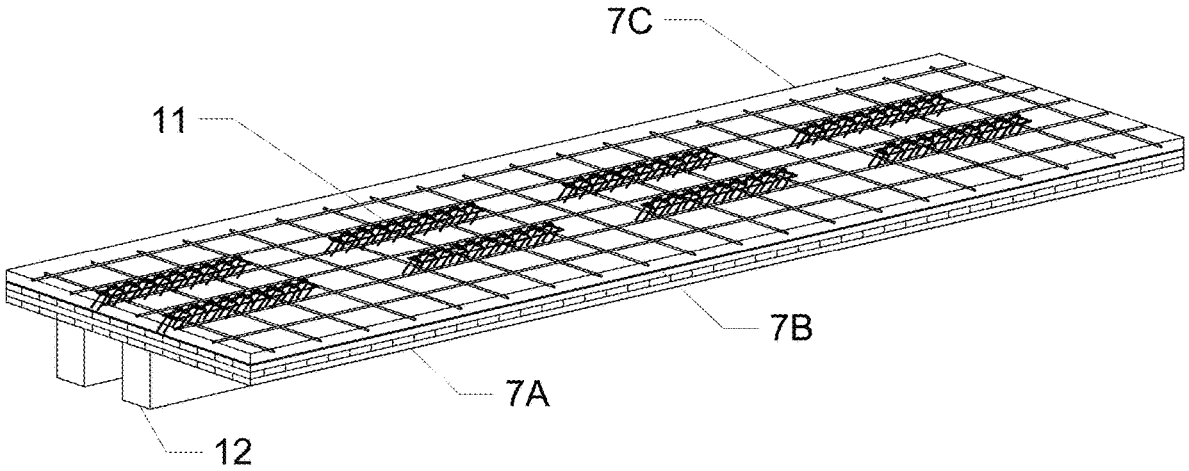
FIG. 15 is an isometric view of first embodiment TC3 connectors installed along timber beams supporting a CLT deck in an overall floor system.

FIG. 15 is an isometric view of TC3 connectors 11 installed along timber beams 12 supporting a CLT deck 7A in an overall floor system.

Figure 16A:
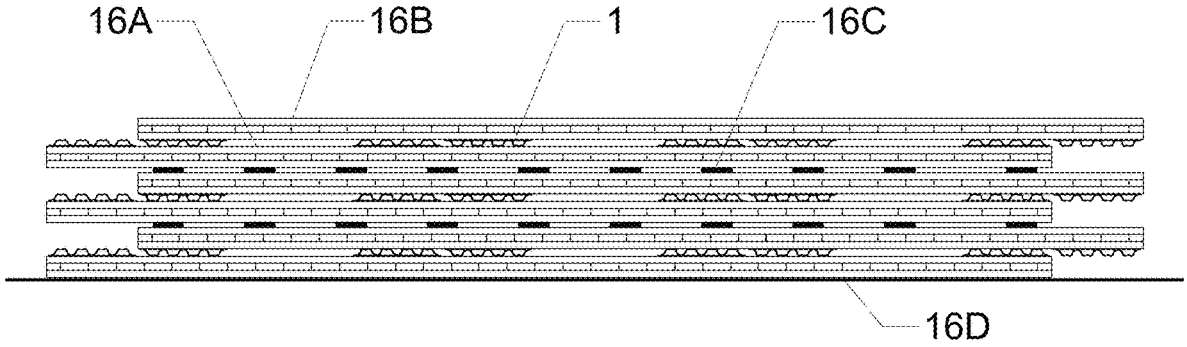
FIG. 16A is an elevation diagram illustrating mass-timber panels with TC3 connectors that were attached in the shop and stacked for shipping.

FIG. 16A is an elevation diagram showing mass-timber panels 16A and 16B with prefabricated TC3 connections 1 which are stacked in a nested orientation for shipping. Mass-timber panels can be stacked in an alternating fashion with panel 16A in the upright position and panel 16B placed upside down on panel 16A. Additional shipping spacers 16C can also be provided if required. The nested grouping of CLT panels are then shipped by conventional methods such as flatbed semi-truck or standard shipping container bed 16D.

Figure 16B:
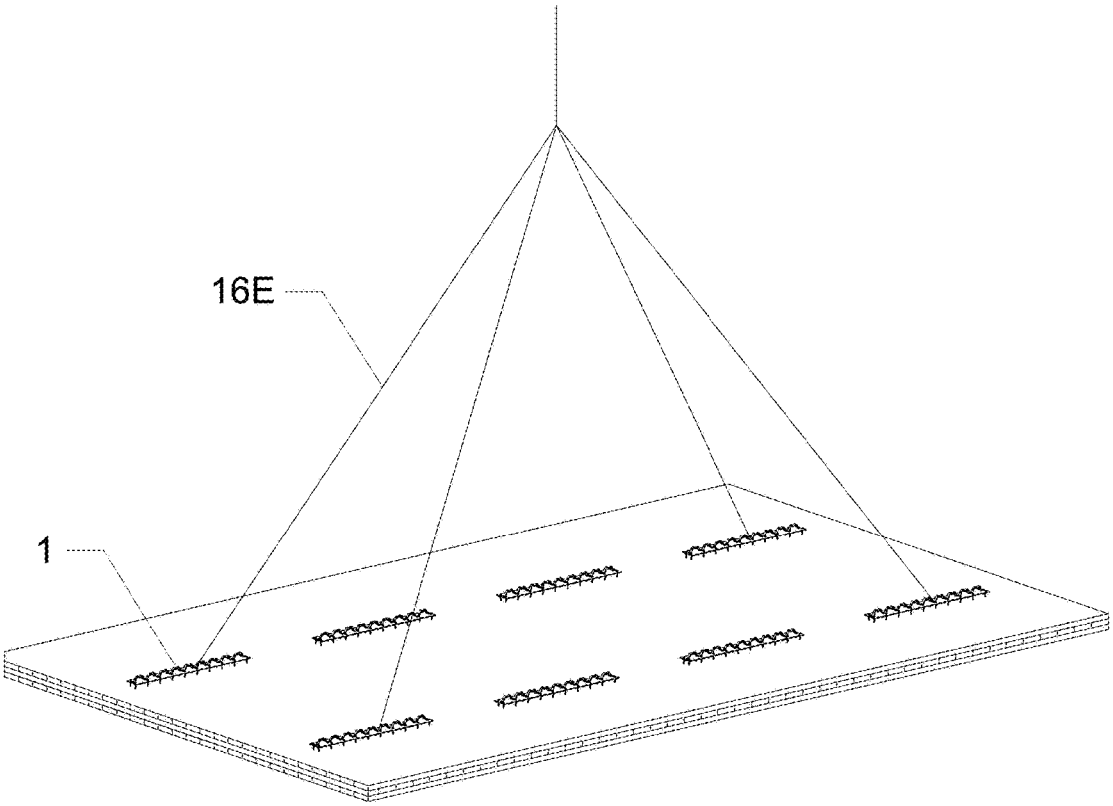
FIG. 16B is an isometric view of a mass-timber panel being hoisted with TC3 connectors as the crane rigging attachment points.

FIG. 16B is an isometric diagram showing TC3 connectors 1 being utilized as hoisting attachment points for crane rigging 16E.

Figure 17:
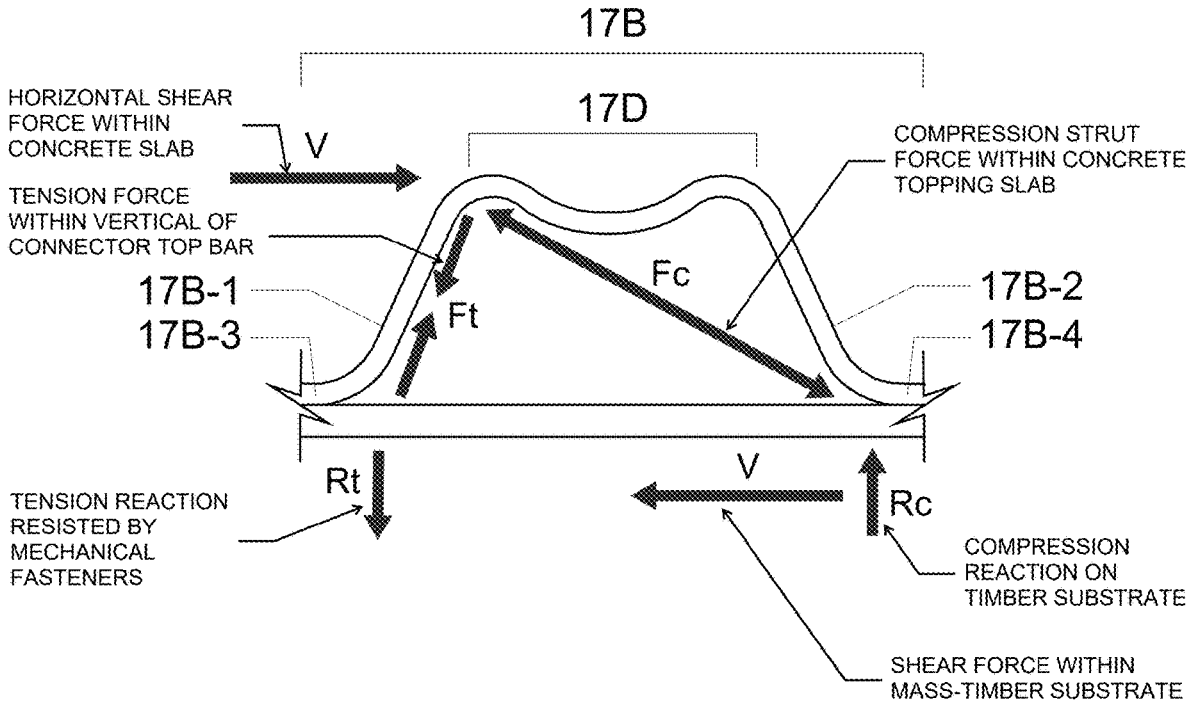
FIG. 17 is a diagram for illustrating truss forces present in a module of a TC3 connector with a ductile reinforcement chair embodying principles present herein.

FIG. 17 is a diagram useful for illustrating the truss forces present in a module of a TC3 connector with a ductile reinforcement chair.

FIG. 17 is a diagram useful for illustrating the truss forces present in a module of a TC3 connector with a ductile reinforcement chair. As can be easily understood from FIG. 17. FIG. 17 illustrates that a steel top bar module 17B, generally represents each of the top bar modules disclosed herein, regardless of how formed. The top bar module 17B defines an upright module (i.e., upright relatively to the steel base plate) which (a) is continuously curvilinear, at least between two endpoints 17B-3 and 17B-4, (b) has two relatively straight segments 17B-1 and 17B-2 that define vertical legs that are inclined toward each other, and thus angled with respect to a base plate, and (c) has a relatively horizontal section between the two inclined legs, the horizontal section preferably having a dip defining a chair 17D. As can be easily understood, the top bar modules 1B, 2B, 4B, and 6B have endpoints on continuums between the top bar modules, while top bars 3B and 5B have endpoints at discontinuities between the top bar modules. As also illustrated in FIG. 17, horizontal shear force "V" is transferred between a concrete topping slab and mass-timber substrate through a strut-and-tie behavior. The horizontal shear is primarily transferred through diagonal compression "Fc" of the concrete slab below and encasing the top bar of the connector. Opposing tension forces "Ft" will occur in the vertical leg of the connector top bar. The intentional weak point of the connection is the tension capacity of the vertical leg and yielding of this element is desired to provide ductility to the system. Overturning moment reactions "Rt" and "Rc" generally counteract each other in a continuous TC3 connector with multiple modules except for the ends of the connectors. Tension in the mechanical fasteners and compression on the mass-timber panels resist the overturning demands at the ends of the connectors.

As also illustrated in FIG. 17, horizontal shear force "V" is transferred between a concrete topping slab and mass-timber substrate through a strut-and-tie behavior. The horizontal shear is primarily transferred through diagonal compression "Fc" of the concrete slab below and encasing the top bar of the connector. Opposing tension forces "Ft" will occur in the vertical leg of the connector top bar. The intentional weak point of the connection is the tension capacity of the vertical leg and yielding of this element is desired to provide ductility to the system. Overturning moment reactions "Rt" and "Rc" generally counteract each other in a continuous TC3 connector with multiple modules except for the ends of the connectors. Tension in the mechanical fasteners and compression on the mass-timber panels resist the overturning demands at the ends of the connectors.

Figure 18A:
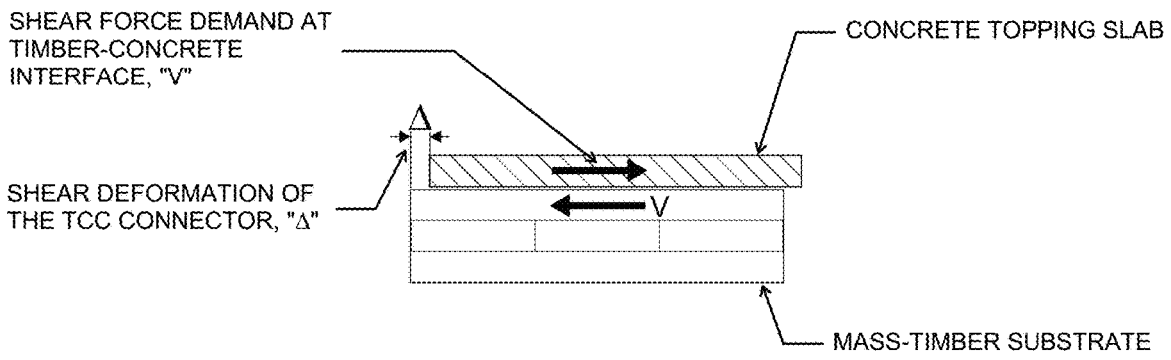
FIGS. 18A and 18B are diagrams illustrating the expected ductile behavior of a TC3 connector with a ductile reinforcement chair embodying principles presented herein, with FIG. 18A illustrating shear force demands at the timber-concrete interface and the shear deformation.
Figure 18B:
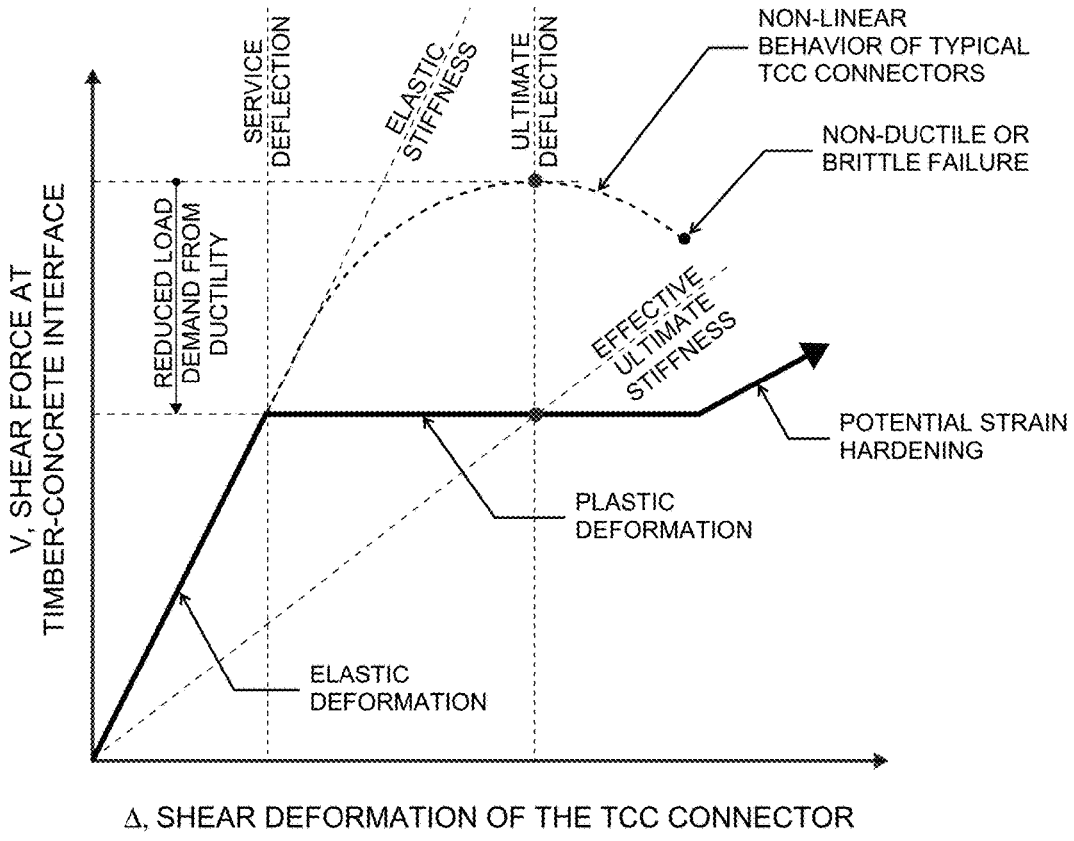

FIG. 18A is a diagram illustrating shear force demands "V" at the timber-concrete interface and the shear deformation "A". FIG. 18B is a diagram illustrating the shear load and deformation curve of typical TCC connectors and the expected curve for TC3 connector with a ductile reinforcement chair embodying principles presented herein. The vertical axis represents shear slip load demands at the interface between the timber substrate and the concrete topping slab. The horizontal axis represents the shear slip deformation of the TCC connector. Such curves are well studied for structural beams and the like.

As can be seen, prior art TCC connectors first experience a distortion that is proportional to the shear loading. This distortion is considered elastic distortion, and this phase is so noted in FIG. 18B. Thereafter the prior art TCC connectors experience non-linear shear deformation as loads approach ultimate loads, as also noted in FIG. 18B. Thereafter, as shear loading increases, the prior art connectors eventually fail.

In contrast, the expected behavior for a TC3 connector with a ductile reinforcement chair embodying principles presented herein is to remain in the initial elastic portion of the curve for service level loading. The TC3 connector with a ductile reinforcement chair embodying principles presented herein will yield at the top bar reinforcing chair during ultimate loading events (i.e., that region between Service and Ultimate along the Shear Deformation axis) and will experience linear or effectively linear plastic deformation. Preferably, as illustrated in FIG. 18B, the plastic deformation is constant or relatively constant (i.e., constant relative to the shear loading). Thus, in FIG. 18B, the plastic deformation is illustrated as both linear and constant. The yielding of the ductile top bar allows the TC3 connector to slip yet maintain load and will follow the plastic deformation portion of the curve for an extended range of shear loading. This minimizes the design forces on the TC3 connectors and allows fewer to be used without reducing the performance of the composite system in service. Eventually, of course, with sufficient shear loading, the TC3 connector with fail like all other structural elements.

What is claimed is:

1. A timber-concrete composite connector comprising:

a steel base plate which is configured to be attached to a timber substrate and which when attached to the timber substrate achieves a rigid connection with the timber substrate, the steel base plate extending along a longitudinal direction; and a steel top bar unitary with or secured to the steel base plate and which has at least one steel top bar module that is designed to yield under ultimate horizontal shear loads applied in the longitudinal direction and experience linear or effectively linear plastic deformation under the ultimate loads while the steel base plate and timber substrate remain elastic, the steel top bar extending along the longitudinal direction with the at least one steel top bar module located on an effective plane which is perpendicular to a plane of the steel base plate, the at least one steel top bar module (a) having two inclined legs, which are relatively straight segments that are inclined toward each other relative to the longitudinal direction, and (b) having a relatively horizontal segment between the two inclined legs.

2. The timber-concrete composite connector of claim 1, wherein the at least one steel top bar module is designed to experience elastic deformation below ultimate loads, yield when subjected to the ultimate loads, and experience constant or effectively constant plastic deformation when subjected to the ultimate loads.

3. The timber-concrete composite connector of claim 1, wherein:

the steel top bar and the base plate are a unitary structure; and the steel top bar and the base plate are pressed, stamped or expanded from a same sheet of steel.

4. The timber-concrete composite connector of claim 1, wherein:

the steel top bar and the base plate are a unitary structure; and the steel top bar and the base plate are cut and bent or cut and folded from a same sheet of steel.

5. The timber-concrete composite connector of claim 1, wherein:

the steel top bar comprises a deformed reinforcing bar, steel wire, or steel gage metal; and the steel top bar is welded to the steel base plate.

6. The timber-concrete composite connector of claim 1, wherein the base plate has holes, each with a longitudinal axis that is not orthogonal to an effective plane of the base plate.

7. The timber-concrete composite connector of claim 1, wherein the timber-concrete composite connector is configured to accommodate an acoustic material layer between the base plate and the topping slab in which the reinforcing bar is embedded.

8. The timber-concrete composite connector of claim 1, wherein the steel base plate is, at least in part, configured to be attached to the timber substrate with mechanical fasteners.

9. The timber-concrete composite connector of claim 8, wherein the steel base plate is configured to be attached to the timber substrate with adhesive and the mechanical fasteners.

10. The timber-concrete composite connector of claim 1, wherein the horizontal segment of the at least one steel top bar module has a dip defining a chair.

11. The timber-concrete composite connector of claim 1, wherein the at least one steel top bar module is formed from and protrudes from the steel base plate.

12. The timber-concrete composite connector of claim 11, comprising plural steel top bar modules all of which are arrayed along the longitudinal direction and on the effective plane, the steel base plate configured to be attached to the timber substrate by mechanical fasteners at effective endpoints of adjacent steel top bar modules.

13. The timber-concrete composite connector of claim 1, comprising plural steel top bar modules all of which are arrayed along the longitudinal direction and on the effective plane, the steel base plate configured to be attached to the timber substrate by mechanical fasteners at effective endpoints of adjacent steel top bar modules.

14. The timber-concrete composite connector of claim 1, wherein the horizontal segment of the at least one steel top bar module has a dip defining a chair that can receive a reinforcement bar extending transverse to the longitudinal direction.

15. The timber-concrete composite connector of claim 1, wherein the at least one steel top bar module is continuously curvilinear along the two inclined legs and the horizontal segment.

16. A timber-concrete composite structure comprising:

a timber-concrete composite connector according to claim 1; and a timber substrate to which the timber-concrete connector is attached, wherein the timber substrate comprises cross-laminated timber (CLT), glued-laminated timber panels (GLT), nail-laminated timber (NLT), dowel-laminated timber (DLT), laminated veneer lumber (LVL), mass plywood panels (MPP), glued-laminated beams (Glulam), or parallel strand lumber (PSL).

17. The timber-concrete composite structure of claim 16, wherein the timber substrate comprises bamboo.

18. The timber-concrete composite structure of claim 16, comprising a concrete topping slab in which the timber-concrete composite connector is embedded.

19. The timber-concrete composite structure of claim 16, wherein the concrete topping slab comprises gypsum concrete.

20. The timber-concrete composite structure of claim 16, comprising, supported by the at least one steel top bar module chair, deformed reinforcing bars, welded wire fabric, post-tensioning cables, carbon fiber rods, glass fiber rods, or basalt rods.

21. The timber-concrete composite structure of claim 16, comprising an acoustic layer between the timber substrate and concrete topping slab, the acoustic layer comprising a rubber mat, a fiber mat, or a foam sheet.

22. The timber-concrete composite structure of claim 16, wherein the steel base plate is, at least in part, secured to the timber substrate with mechanical fasteners.

23. The timber-concrete composite structure of claim 22, wherein the steel base plate is secured to the timber substrate with adhesive and the mechanical fasteners.

24. A timber-concrete composite connector comprising:

a steel base plate which is configured to be attached to a timber substrate and which when attached to the timber substrate achieves a rigid connection with the timber substrate, the steel base plate extending along a longitudinal direction;

a steel top bar unitary with or secured to the steel base plate and which has at least one steel top bar module that is designed to yield under ultimate horizontal shear loads applied in the longitudinal direction and experience linear or effectively linear plastic deformation under the ultimate loads while the steel base plate and timber substrate remain elastic, the steel top bar extending along the longitudinal direction with the at least one steel top bar module located on an effective plane which is perpendicular to a plane of the steel base plate, the at least one steel top bar module (a) having two inclined legs, which are relatively straight segments that are inclined toward each other relative to the longitudinal direction, and (b) having a relatively horizontal segment between the two inclined legs; and a chair formed in the steel top bar in the form of a dip in the horizontal segment and that can receive a reinforcement bar extending transverse to the longitudinal direction.

25. The timber-concrete composite of claim 24, wherein the at least one steel top bar module is continuously curvilinear along the two inclined legs and the horizontal segment.

* * * * *